US011131476B2

(12) United States Patent
Hamada et al.

(10) Patent No.: US 11,131,476 B2
(45) Date of Patent: Sep. 28, 2021

(54) WATER COOLED-TYPE AIR CONDITIONING SYSTEM

(71) Applicant: Mitsubishi Electric Corporation, Tokyo (JP)

(72) Inventors: Mamoru Hamada, Tokyo (JP); Hayato Horie, Tokyo (JP); Masaki Toyoshima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 218 days.

(21) Appl. No.: 16/327,178

(22) PCT Filed: Oct. 21, 2016

(86) PCT No.: PCT/JP2016/081356

§ 371 (c)(1),
(2) Date: Feb. 21, 2019

(87) PCT Pub. No.: WO2018/073968

PCT Pub. Date: Apr. 26, 2018

(65) Prior Publication Data

US 2020/0018513 A1 Jan. 16, 2020

(51) Int. Cl.
*F24F 11/00* (2018.01)
*F24F 11/84* (2018.01)
(Continued)

(52) U.S. Cl.
CPC ..... *F24F 11/84* (2018.01); *F24F 3/14* (2013.01); *F24F 5/0017* (2013.01); *F24F 11/46* (2018.01);
(Continued)

(58) Field of Classification Search
CPC .... F24F 11/84; F24F 3/14; F24F 11/46; F24F 11/67; F24F 2003/144; F24F 2203/021
See application file for complete search history.

(56) References Cited

U.S. PATENT DOCUMENTS 5,170,635 A * 12/1992 Wruck ..... F24F 3/06 62/140
2014/0298834 A1* 10/2014 Gast, Jr. ..... H05K 7/20836 62/119

FOREIGN PATENT DOCUMENTS

JP 2002-061911 A 2/2002
JP 2005-207712 A 8/2005
JP 2008-281219 A 11/2008

OTHER PUBLICATIONS

International Search Report dated Dec. 20, 2016 issued in corresponding international application No. PCT/JP2016/081356 (and English translation thereof).

* cited by examiner

*Primary Examiner* — Jonathan Bradford
(74) *Attorney, Agent, or Firm* — Posz Law Group, PLC

(57) ABSTRACT

In an air conditioning system, a cooling tower cools cooling water. A chiller generates cold water using the cooling water cooled by the cooling tower. A cooling water circulation passage circulates cooling water between the cooling tower and chiller. A first heat exchanger exchanges heat between air and the cold water generated by the chiller. A cold water circulation passage circulates the cold water between the chiller and first heat exchanger. A second heat exchanger exchanges heat between a portion of the cooling water cooled by the cooling tower and air heat-exchanged with the cold water. A cooling water branch passage, branching from the cooling water circulation passage, introduces to the second heat exchanger the portion of the cooling water introduced to the chiller from the cooling tower, and introduces to the cooling water circulation passage the portion of the cooling water heat-exchanged with air by the second heat exchanger.

13 Claims, 19 Drawing Sheets

(51) Int. Cl.

| | |
|---|---|
| ***F24F 3/14*** | (2006.01) |
| *F24F 11/46* | (2018.01) |
| *F24F 11/67* | (2018.01) |
| *F24F 5/00* | (2006.01) |

(52) U.S. Cl.
CPC ..... *F24F 11/67* (2018.01); *F24F 2003/144* (2013.01); *F24F 2005/0025* (2013.01); *F24F 2203/021* (2013.01)

WATER COOLED-TYPE AIR CONDITIONING SYSTEM

CROSS REFERENCE TO RELATED APPLICATION

This application is a U.S. national stage application of PCT/JP2016/081356 filed on Oct. 21, 2016, the contents of which are incorporated herein by reference.

TECHNICAL FIELD

The present disclosure relates to an air conditioning system.

BACKGROUND ART

Technology is known that air-conditions by using cooling water to cool cold water and performing heat exchange between the cold water and air.

For example, Patent Literature 1 mentions an air conditioning system equipped with a cold water circuit that supplies to an air conditioner cold water generated by a thermal source device, and a cooling water circuit that uses a cooling tower to release to the atmosphere waste heat recovered by the cold water circuit. In the air conditioning system mentioned in Patent Literature 1, when a temperature of the cooling water is lower than or equal a threshold, the thermal source device is bypassed, and the cooling water is supplied directly to the air conditioner, thereby achieving free cooling. Such operation enables energy conservation during a decrease in outside air temperature.

CITATION LIST

Patent Literature

Patent Literature 1: Unexamined Japanese Patent Application Kokai Publication No. 2008-281219

SUMMARY OF INVENTION

Technical Problem

Although the air conditioning system mentioned in Patent Literature 1 can achieve free cooling during a period when the outside air temperature is low, the air conditioning system is unable to achieve free cooling during a period when the outside air temperature is high. Thus the period of enablement of free cooling is limited. In consideration of such circumstances, air cooling is desired that more effectively uses the cooling water.

In order to solve problems such as those described above, an objective of the present disclosure is to provide an air conditioning system and the like capable of effectively using cooling water in air conditioning using cooling water and cold water.

Solution to Problem

An air conditioning system includes:

a cooling tower configured to cool cooling water;

a thermal source device configured to generate cold water by the cooling water cooled by the cooling tower;

a cooling water circulation passage configured to allow circulation of the cooling water between the cooling tower and the thermal source device;

a first heat exchanger configured to exchange heat between air and the cold water generated by the thermal source device;

a cold water circulation passage configured to allow circulation of the cold water between the thermal source device and the first heat exchanger;

a second heat exchanger configured to exchange heat between a portion of the cooling water cooled by the cooling tower and the air heat-exchanged with the cold water by the first heat exchanger; and a cooling water branch passage, branching from the cooling water circulation passage, configured to (i) introduce to the second heat exchanger the portion of the cooling water introduced to the thermal source device from the cooling tower, and (ii) introduce to the cooling water circulation passage the portion of the cooling water heat-exchanged with the air by the second heat exchanger.

Advantageous Effects of Invention

According to the present disclosure, cooling water cooled by the cooling tower circulates between the cooling tower and the thermal source device, the cold water generated by the thermal source device circulates between the thermal source device and the first heat exchanger, the first heat exchanger exchanges heat between the air and the cold water generated by the thermal source device, a portion of the cooling water introduced from the cooling tower to the thermal source device is introduced to the second heat exchanger, and the second heat exchanger exchanges heat between the air heat-exchanged with cold water by the first heat exchanger and the portion of the cooling water cooled by the cooling tower. Thus the present disclosure enables effective use of cooling water for air conditioning using cooling water and cold water.

DESCRIPTION OF EMBODIMENTS

Figure 1:
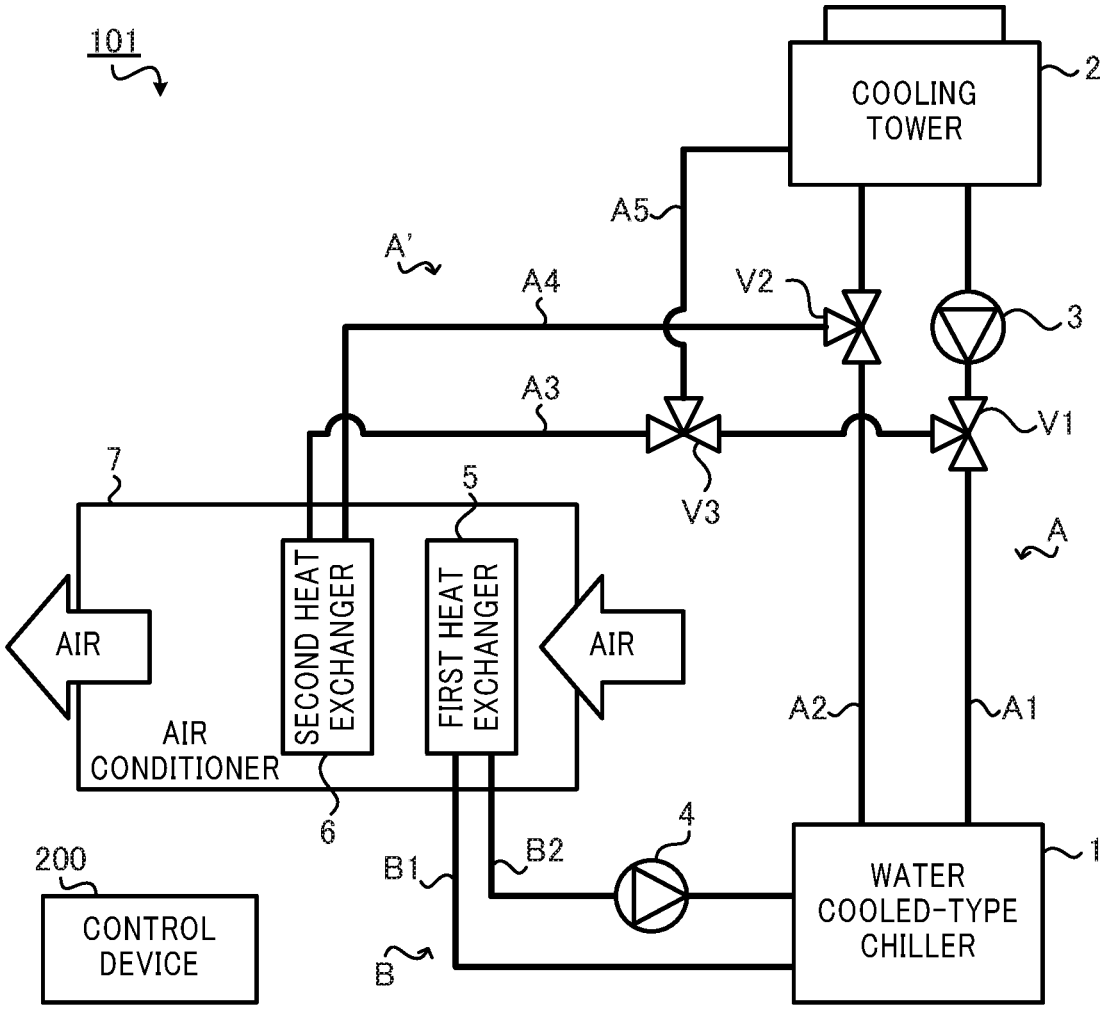
FIG. 1 is a schematic drawing of an air conditioning system according to Embodiment 1 of the present disclosure.

Embodiments of the present disclosure are described below in detail with reference to drawings. In the drawings, components that are the same or equivalent are assigned the same reference sign. Items not particularly described in Embodiments 2, Embodiment 3, and beyond are similar to such items in Embodiment 1.

Embodiment 1

FIG. 1 schematically illustrates an air conditioning system 101 of Embodiment 1 of the present disclosure. The air conditioning system 101 is a system that uses cooling water cooled by a cooling tower 2 to air-condition an air conditioning target space that is referred to hereinafter as the "air conditioning space". The term "air conditioning" means the adjustment of temperature, humidity, purity, flow, or the like of air of the air conditioning space, and includes specifically heating, cooling, dehumidification, humidification, air purification, or the like. Examples of the "air conditioning space" include internal spaces such as general homes, group residences, office buildings, facilities, and factories.

As illustrated in FIG. 1, the air conditioning system 101 includes: a water cooled-type chiller 1 that generates cold water, a cooling tower 2 that uses outside air to cool cooling water, a cooling water pump 3 that circulates the cooling water, a cold water pump 4 that circulates the cold water, a first heat exchanger 5 that exchanges heat between air and the cold water, a second heat exchanger 6 that exchanges heat between the air and the cooling water, an air conditioner 7 that includes the first heat exchanger 5 and the second heat exchanger 6, three valves (first valve V1, second valve V2, and third valve V3) that switch the flow path of the cooling water, and a control device 200 that control the entire system.

Further, the air conditioning system 101 includes, as flow paths of the cooling water or the cold water between various structures, a cooling water circulation passage A for allowing circulation of the cooling water, a cooling water branch passage A' branching from the cooling water circulation passage A, and a cold water circulation passage B for allowing circulation of the cold water. The air conditioning system 101 uses the cooling water as a primary cooling medium and the cold water as a secondary cooling medium, and is a so-called secondary cooling medium circulation type or an indirect cooling type system.

Water Cooled-Type Chiller 1

The water cooled-type chiller 1 is a device that generates the cold water. The "cold water" is a medium for cooling the air of the air conditioning space. The water cooled-type chiller 1 exchanges heat between the cooling water and the cold water, and functions as a thermal source device that uses the cooling water as a cold thermal source to cool the cold water. The water cooled-type chiller 1 is a heat pump-type chiller that uses a cooling medium such as $CO_2$ (carbon dioxide) or a hydrofluorocarbon (HFC), for example. The water cooled-type chiller 1 is installed, for example, to the exterior of the air conditioning space and within the same site of that of the air conditioning space.

Figure 2:
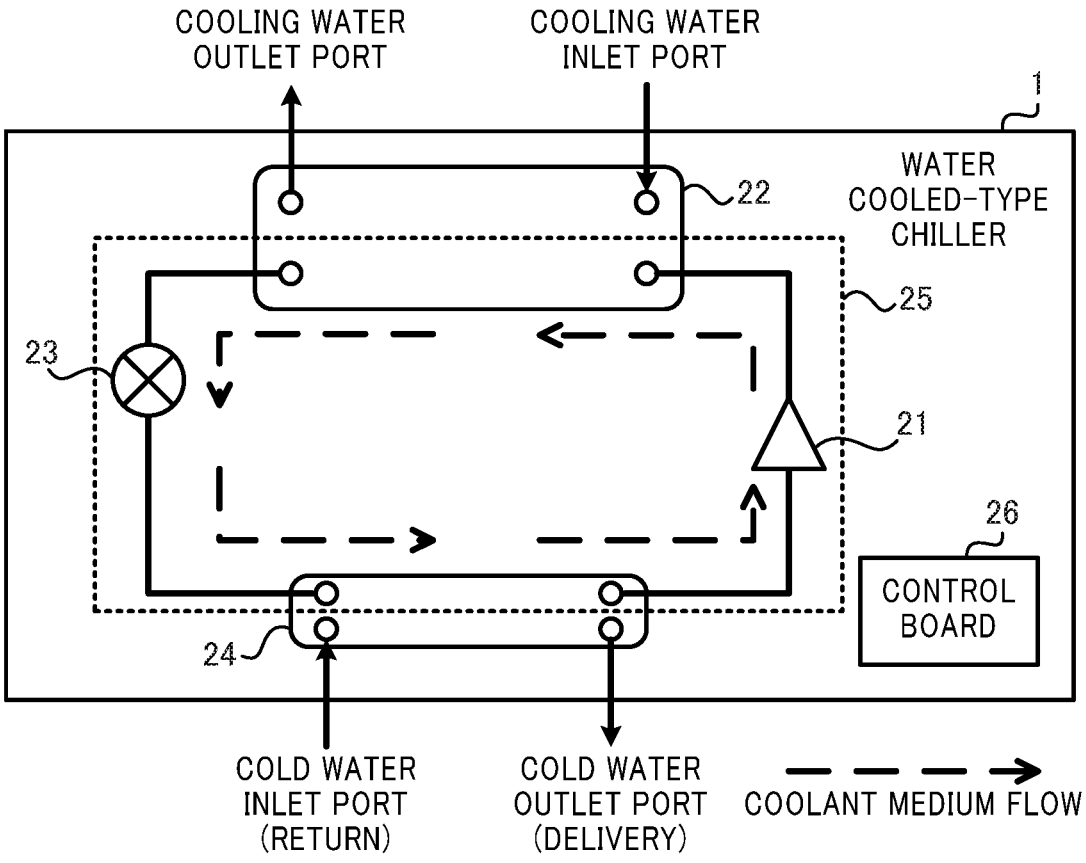
FIG. 2 is a schematic drawing of a water cooled-type chiller.

As illustrated in FIG. 2, the water cooled-type chiller 1 includes a compressor 21, a first cooling medium-water heat exchanger 22, an expansion device 23, a second cooling medium-water heat exchanger 24, a cooling medium circuit 25 that connects these components in a loop, and a control board 26. The cooling medium circuit 25 is a circuit through which the cooling medium circulates, and is called a heat pump, refrigeration cycle, or the like.

The compressor 21 compresses the cooling medium flowing through the cooling medium circuit 25, and causes increases in the temperature and pressure of the cooling medium. The compressor 21 is equipped with an inverter circuit that is capable of changing capacity (amount of output per unit) in accordance with an operation frequency (rotational frequency). The compressor 21 changes the operational frequency in accordance with a control value received as a command from the control board 26. The cooling medium sucked into the compressor 21 is compressed and discharged as the gaseous cooling medium at high temperature and high pressure.

The first cooling medium-water heat exchanger 22 exchanges heat between the cooling medium flowing through the cooling medium circuit 25 and the cooling water supplied from the cooling tower 2. The first cooling medium-water heat exchanger 22 is a plate-type or double tube-type heat exchanger, for example. The cooling medium at high temperature and high pressure compressed by the compressor 21 is condensed due to heat exchange with the cooling water by the first cooling medium-water heat exchanger 22, and changes into a high pressure liquid. During condensation of the cooling medium in the first cooling medium-water heat exchanger 22, the cooling water is heated, and thus the temperature of the cooling water rises.

The expansion device 23 allows expansion of the cooling medium flowing through the cooling medium circuit 25 and causes a lowering of the temperature and pressure of the cooling medium. The expansion device 23 changes a degree of opening of a valve in accordance with a control value received as a command from the control board 26, and adjusts a decompression amount of the cooling medium. The cooling medium liquefied into a high pressure liquid by the first cooling medium-water heat exchanger 22 is decompressed by the expansion device 23 to become a two-phase cooling medium at low temperature and low pressure.

The second cooling medium-water heat exchanger 24 exchanges heat between the cooling medium flowing through the cooling medium circuit 25 and the cold water supplied from the air conditioner 7. The second cooling medium-water heat exchanger 24 is a plate-type or double tube-type heat exchanger, for example. The cooling medium decompressed by the expansion device 23 vaporizes due to heat exchange with the cold water by the second cooling medium-water heat exchanger 24, and changes to a low pressure gas. The cooling medium changed to the low pressure gas returns to the compressor 21, and is compressed again to high temperature and high pressure gas. When the cooling medium is vaporized by the second cooling medium-water heat exchanger 24, heat is lost by the cold water, and thus the temperature of the cold water declines.

The control board 26 is equipped with components, all of which are non-illustrated, such as a CPU, ROM, RAM, communication interface, read-writable non-volatile semiconductor memory, and the like. The control board 26 is connected in a communication-capable manner via non-illustrated communication lines to the compressor 21 and the expansion device 23. Also, the control board 26 is connected in a communication-capable manner via a non-illustrated communication line to the control device 200. The control board 26 controls operation of the compressor 21 and the expansion device 23 in accordance with commands transmitted from the control device 200.

Cooling Tower 2

The cooling tower 2 is equipment that cools the cooling water. The "cooling water" is a medium for cooling the cold water by the water cooled-type chiller 1. The cooling tower 2 is equipped with an air blower for blowing the outside air, and cools the cooling water by heat exchange between the cooling water and the outside air. Specifically, the cooling tower 2 cools the cooling water by a method (open method) that causes evaporation by directly contacting the cooling water with the outside air, or alternatively, cools the cooling water by a method (closed method) that circulates a thermal medium contacting the outside air to thereby cause indirect contacting of the cooling water with the outside air. In this manner, the cooling tower 2 cools the cooling water by causing direct or indirect contact of the outside air with the cooling water. The cooling tower 2, for example, is outside the air conditioning space, and is installed within the same site as that of the air conditioning space.

The cooling tower 2 is equipped with a control board that includes components, all of which are non-illustrated, such as a CPU, ROM, RAM, communication interface, read-writable non-volatile semiconductor memory, and the like. The control board is connected in a communication-capable manner via a non-illustrated communication line to the control device 200. The control board controls operation of the cooling tower 2 in accordance with commands transmitted from the control device 200.

Air Conditioner 7

The air conditioner 7 is equipment that air conditions the air conditioning space. The air conditioner 7 is also termed the "air handling unit" (AHU). The air conditioner 7 is installed in a location from which air conditioned air can be supplied to the air conditioning space. The air conditioner 7, for example, is installed at the ceiling or upper part of a wall of the air conditioning space. Alternatively, the air conditioner 7 may be installed in a dedicated equipment room connected via ducts to multiple rooms that are each the air conditioning space.

Figure 3:
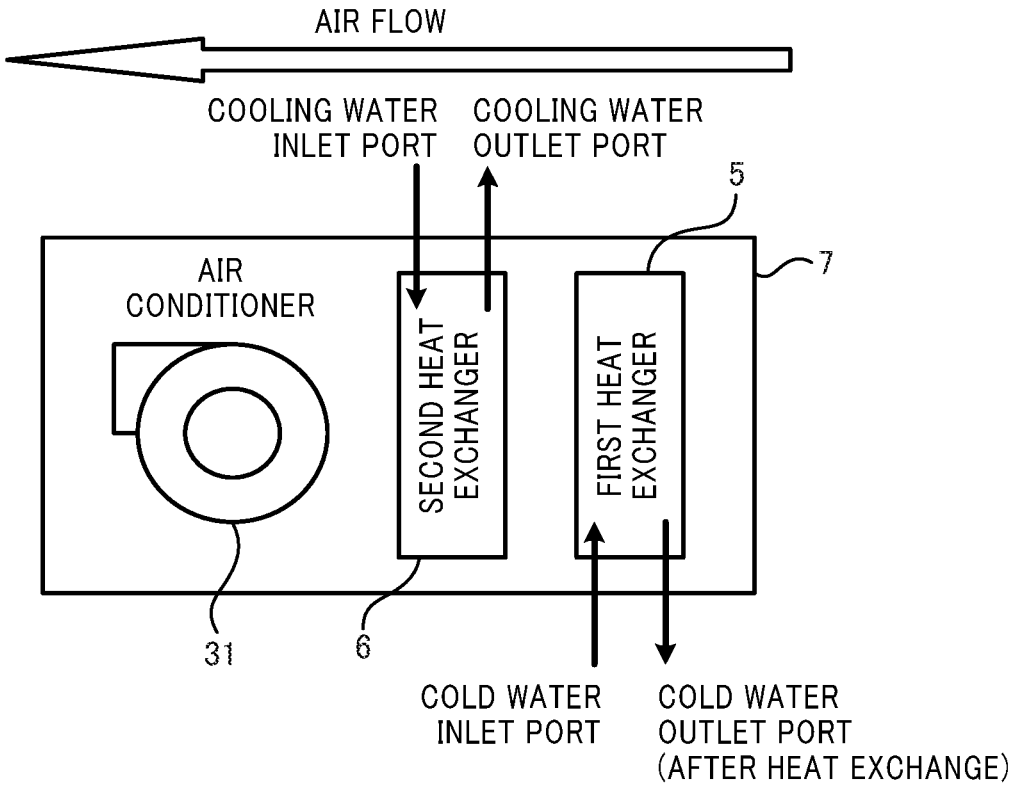
FIG. 3 is a schematic drawing of an air conditioner.

As illustrated in FIG. 3, the air conditioner 7 is equipped with the first heat exchanger 5 that exchanges heat between the air and the cold water, the second heat exchanger 6 that exchanges heat between the air and the cooling water, and an air blowing device 31 that blows the air. The first heat exchanger 5 and the second heat exchanger 6 each exchange heat between the air and water, and are heat exchangers of well-known types. The first heat exchanger 5 exchanges heat between the air and the cold water generated by the water cooled-type chiller 1. The second heat exchanger 6 is installed downstream of the first heat exchanger 5 and exchanges heat between the portion of the cooling water cooled by the cooling tower 2 and the air heat-exchanged with the cold water by the first heat exchanger 5.

The air sucked into the air conditioner 7 by the air blowing device 31 firstly passes through the first heat exchanger 5, and exchanges heat with the cold water. The air heat-exchanged with cold water by the first heat exchanger 5 further passes through the second heat exchanger 6, and exchanges heat with the cooling water. In this manner, the air sucked into the air conditioner 7 is supplied to the air conditioning space after exchanging heat twice.

The air conditioner 7 is equipped with a control board that includes components, all of which are non-illustrated, such as a CPU, ROM, RAM, communication interface, read-writable non-volatile semiconductor memory, and the like. The control board is connected in a communication-capable manner via a non-illustrated communication line to the control device 200. The control board controls operation of the air conditioner 7 in accordance with commands transmitted from the control device 200.

Cooling Water Circulation Passage A, Cooling Water Branch Passage A', and Cold Water Circulation Passage B The cooling water circulation passage A is arranged between the cooling tower 2 and the water cooled-type chiller 1, and allows circulation of the cooling water between the cooling tower 2 and the water cooled-type chiller 1. The cooling water circulation passage A is equipped with a first cooling water passage A1 and a second cooling water passage A2 that are each connected to both the cooling tower 2 and the water cooled-type chiller 1. The first cooling water passage A1 introduces the cooling water cooled by the cooling tower 2 to the water cooled-type chiller 1, and is a supply passage (delivery passage) for supplying the cooling water. The second cooling water passage A2 introduces to the cooling tower 2 the cooling water that cooled the cold water at the water cooled-type chiller 1, and is a return flow path (return passage) of the cooling water.

The cooling water branch passage A' is arranged between the cooling water circulation passage A and the second heat exchanger 6, and is a branch passage that diverts, and supplies to the second heat exchanger 6, a portion of the cooling water flowing through the cooling water circulation passage A. In the cooling water circulation passage A, the cooling water branch passage A' introduces to the second heat exchanger 6 the portion of the cooling water introduced from the cooling tower 2 to the water cooled-type chiller 1, and introduces to the cooling water circulation passage A the portion of the cooling water heat-exchanged with air by the second heat exchanger 6.

The cooling water branch passage A' is equipped with: a third cooling water passage A3 that connects together the second heat exchanger 6 and a midway part of the first cooling water passage A1, and a fourth cooling water passage A4 that connects together the second heat exchanger 6 and a midway part of the second cooling water passage A2. The third cooling water passage A3 introduces to the second heat exchanger 6 the portion of the cooling water flowing through the first cooling water passage A1. The fourth cooling water passage A4 introduces to the second cooling water passage A2 the cooling water heat-exchanged with air by the second heat exchanger 6.

Further, the cooling water branch passage A' is equipped with a fifth cooling water passage A5 connecting together the cooling tower 2 and a midway part of the third cooling water passage A3. The fifth cooling water passage A5 is a bypass passage that, without passing through the cooling water circulation passage A, introduces to the cooling tower 2 the cooling water flowing through the third cooling water passage A3.

The cooling water pump 3 is arranged in the cooling water circulation passage A. The cooling water pump 3 outputs the cooling water generated by the cooling tower 2 and causes circulation thereof through the cooling water circulation passage A and the cooling water branch passage A'. The cooling water pump 3 is equipped with an inverter circuit, and by adjustment of a drive rotational frequency in accordance with a control value as commanded by the control device 200, changes the flow amount of cooling water output. The cooling water output by the cooling water pump 3 from the cooling tower 2 passes through the water cooled-type chiller 1 and/or the first heat exchanger 5, and returns to the water cooled-type chiller 1.

The first valve V1, the second valve V2, and the third valve V3 are arranged in the cooling water circulation passage A. The first valve V1, the second valve V2, and the third valve V3 are electromotive three-way valves that open and close, and are valves of well-known types such as solenoid valves or electromotive valves. By switching the valves open or closed in accordance with the control command from the control device 200, the first valve V1, the second valve V2, and the third valve V3 change the flow path of the cooling water.

The first valve V1 switches the flow of the cooling water output from the cooling tower 2 to the first cooling water passage A1 such that the cooling water flows to the water cooled-type chiller 1, or to the second heat exchanger 6, or to both the water cooled-type chiller 1 and the second heat exchanger 6. The second valve V2 switches between introducing to the cooling tower 2 either just one or both of the cooling water output to the second cooling water passage A2 from the water cooled-type chiller 1 and the cooling water output to the fourth cooling water passage A4 from the second heat exchanger 6. The third valve V3 switches between introducing and blocking flow to the fifth cooling water passage A5 of the cooling water flowing through the third cooling water passage A3.

The cold water circulation passage B is arranged between the water cooled-type chiller 1 and the first heat exchanger 5 and allows circulation of the cold water between the water cooled-type chiller 1 and the first heat exchanger 5. The cold water circulation passage B is equipped with a first cold water passage B1 and a second cold water passage B2 that are each connected to both the water cooled-type chiller 1 and the first heat exchanger 5. The first cold water passage B1 introduces to the first heat exchanger 5 the cold water generated by the water cooled-type chiller 1 and is a supply passage (delivery passage) of the cold water. The second cold water passage B2 introduces to the water cooled-type chiller 1 the cold water heat-exchanged with air by the first heat exchanger 5 and is a return flow path (return passage) of cold water.

The cold water pump 4 is arranged in the cold water circulation passage B. The cold water pump 4 outputs the cold water generated by the water cooled-type chiller 1 and causes circulation of the cold water through the cold water circulation passage B. The cold water pump 4 is equipped with an inverter circuit, and by adjustment of a drive rotational frequency in accordance with a control value as commanded by the control device 200, changes an amount of cold water output. The cold water output by the cold water pump 4 from the water cooled-type chiller 1 passes through the first heat exchanger 5, and returns to the water cooled-type chiller 1.

Control Device 200

The control device 200 performs overall control of the air conditioning system 101. The control device 200 is installed, for example, within the air conditioning space, or in a suitable location within the same site as that of the air conditioning space.

Figure 4:
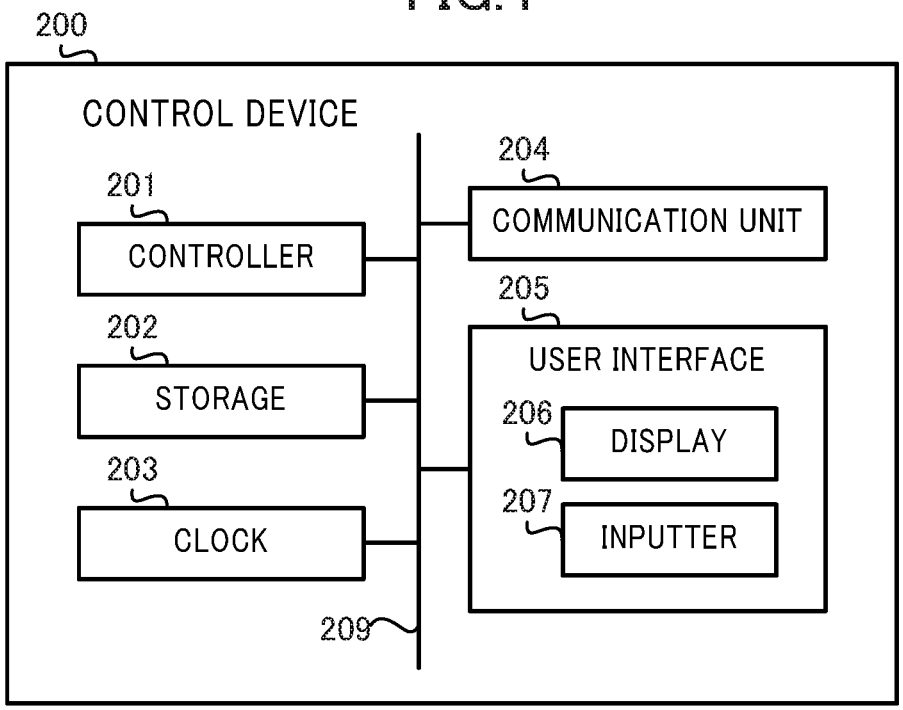
FIG. 4 is a block diagram illustrating a hardware configuration of a control device.

FIG. 4 illustrates a hardware configuration of the control device 200. As illustrated in FIG. 4, the control device 200 is equipped with a controller 201, a storage 202, a clock 203, a communication unit 204, and a user interface 205. These components are interconnected via a bus 209.

The controller 201 is equipped with components, all non-illustrated, such as a CPU, ROM, and RAM. The CPU is also termed a central processor, a central calculator device, a processor, a microprocessor, a microcomputer, a digital signal processor (DSP), or the like. In the controller 201, the CPU reads out programs and data contained in the ROM, and uses the RAM as a work area to perform overall control of the control device 200.

The storage 202 is a non-volatile semiconductor memory such as a flash memory, an erasable programmable ROM (EPROM), or an electrically erasable programmable ROM (EEPROM), and performs the role of a so-called secondary storage (auxiliary storage). The storage 202 stores various types of programs and data used by the controller 201 for performing various types of processing, and stores various types of data generated or acquired by the controller 201 performing the various types of processing.

The clock 203 is equipped with a real time clock (RTC) and is a clock device that continues to measure time even when power to the control device 200 is turned off.

The communication unit 204 is an interface for communication with external equipment. The communication unit 204 is connected, in a wired or wireless manner, so as to be capable of communication with each of the water cooled-type chiller 1, the cooling tower 2, the cooling water pump 3, the cold water pump 4, the air conditioner 7, the first valve V1, the second valve V2, and the third valve V3, and communicates with these component elements in accordance with a well-known communication protocol. Further, the communication unit 204 is connected to a local area network and a wide area network, and communicates with equipment external to the air conditioning system 101.

The user interface 205 is equipped with a display 206 and an inputter 207. The display 206 is a display device such as a liquid crystal display (LCD) panel, an organic EL display, or a light emitting diode (LED) display. The inputter 207 is an input device such as a touch panel, a touch pad, a switch, or various types of pushbuttons. The user interface 205 receives various types of operations from the user via the inputter 207, and displays various types of display images via the display 206. Further, the display 206 and the inputter 207 may be overlaid on each other to form a touch panel (touch screen).

The user interface 205 (the display 206 and the inputter 207) may be provided on a device main body of the control device 200. A remote controller separate from the device main body may function as the user interface 205 without providing the user interface 205 on the device main body. In the case in which the remote controller functions as the user interface 205, the control device 200 communicates with the remote controller via the communication unit 204. The communication unit 204 transmits a signal indicating the display image displayed by the display 206 of the remote controller, and receives a signal indicating operational content received from a user by the inputter 207 of the remote controller.

Figure 5:
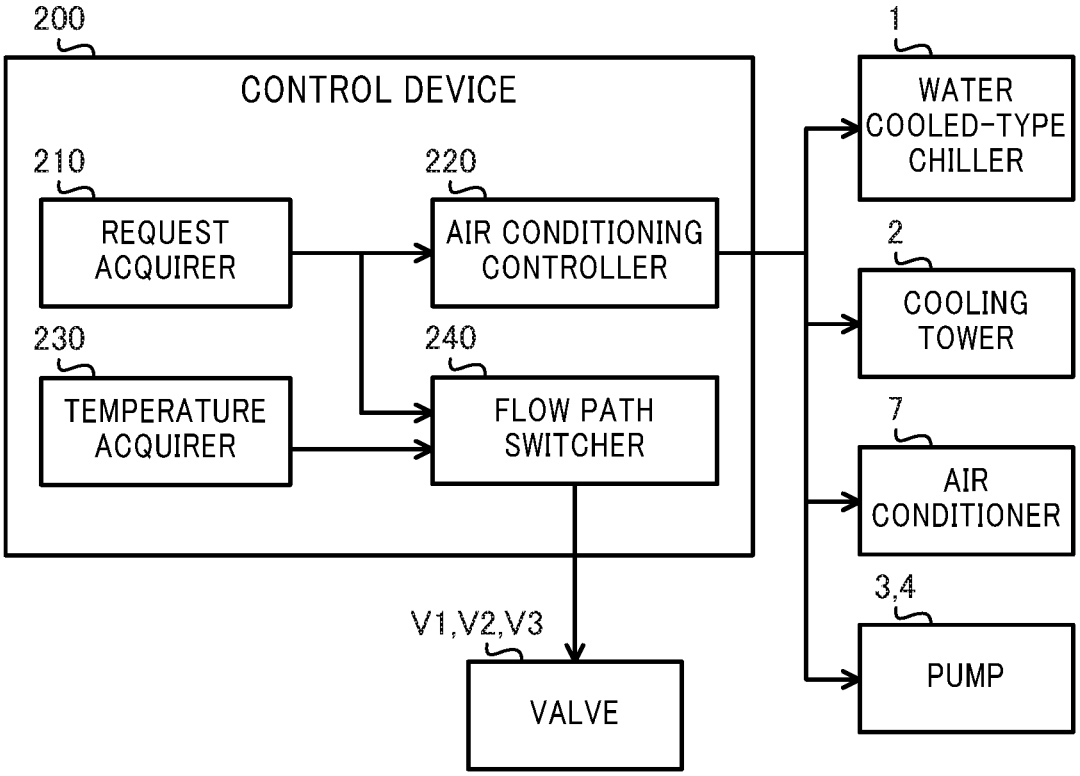
FIG. 5 is a block diagram illustrating a functional configuration of the control device.

The functional configuration of the controller 201 is described next with reference to FIG. 5. As illustrated in FIG. 5, the controller 201 is functionally equipped with a request acquirer 210, an air conditioning controller 220, a temperature acquirer 230, and a flow path switcher 240. Each of these functions is achieved by software, firmware, or a combination of software and firmware. The software and firmware are stored as programs and are contained in the ROM or the storage 202. Further, the various functions are achieved by the CPU executing programs stored in the ROM or the storage 202.

The request acquirer 210 acquires a request for operation of the air conditioning system 101. For example, the user can operate, via the inputter 207 or via the communication unit 204 from the exterior, to input a request for a start of air conditioning, a stoppage of air conditioning, a change of setting temperature, a change of operation mode, or the like. In this manner, the request acquirer 210 acquires the request inputted by the user. Alternatively, the request acquirer 210 acquires via the communication unit 204 a request for operation generated in accordance with a predetermined operation schedule. The request acquirer 210 is achieved by the controller 201 in cooperation with the communication unit 204, the inputter 207, or the like.

As described below in detail, the air conditioning system 101 can air-condition in a "cooling" or a "reheat dehumidification" operation mode. More specifically, the operations modes include "normal cooling" and "free cooling" as "cooling" operation modes, and include "first reheat dehumidification" and "second reheat dehumidification" as the "reheat dehumidification" operation modes. The user can select a desired operation mode from among the "cooling" and the "reheat dehumidification" operation modes. The request acquirer 210 in this manner acquires the selected operation mode.

The air conditioning controller 220 controls air conditioning operations occurring in the air conditioning system 101. Specifically, the air conditioning controller 220, via the communication unit 204, communicates with each of the water cooled-type chiller 1, the cooling tower 2, the cooling water pump 3, cold water pump 4, and the air conditioner 7, and transmits commands for operations to the various equipment. The air conditioning controller 220 is achieved by the controller 201 in cooperation with the communication unit 204.

For example, in the case in which the request acquirer 210 acquires the request for the start of air conditioning, the air conditioning controller 220 transmits a command to start operation of the water cooled-type chiller 1 to the control board 26, causes operation of the compressor 21 and the expansion device 23, and causes the water cooled-type chiller 1 to generate the cold water. Simultaneously, the air conditioning controller 220 causes operation of the cooling water pump 3 and the cold water pump 4, and causes circulation of the cooling water and the cold water. Further, the air conditioning controller 220 transmits a command to start operation to the cooling tower 2 and the air conditioner 7, causes the cooling tower 2 to cool the cooling water, and causes the air conditioner 7 to start air conditioning.

The temperature acquirer 230 acquires the outside air temperature. The "outside air temperature" means the temperature of outdoor air at the exterior of the air conditioning space. The outside air temperature is sensed by a non-illustrated temperature sensor, such as a thermistor or thermocouple, arranged outdoors. The temperature acquirer 230, via the communication unit 204, acquires information of the outside air temperature sensed by the temperature sensor. The temperature acquirer 230 is achieved by the controller 201 in cooperation with the communication unit 204.

The flow path switcher 240 switches the flow paths of the cooling water occurring in the cooling water circulation passage A and the cooling water branch passage A'. The "flow path of the cooling water" is the path of circulation of the cooling water in the cooling water circulation passage A and the cooling water branch passage A'.

The flow path switcher 240, via the communication unit 204, switches open and closed each of the first valve V1, the second valve V2, and the third valve V3, thereby switching the direction of flow of the cooling water through each of the three-way valves. Thus the flow path switcher 240 changes the flow path of the cooling water. The flow path switcher 240 is achieved by the controller 201 in cooperation with the communication unit 204.

More specifically, in accordance with the operation mode acquired by the request acquirer 210 and the outside air temperature acquired by the temperature acquirer 230, the flow path switcher 240 switches the flow path of the cooling water. The air conditioning system 101 is described below during operation in each of the "normal cooling", the "first reheat dehumidification", the "second reheat dehumidification", and the "free cooling" operation modes.

Normal Cooling

Firstly, operation in the "normal cooling" operation mode is described. Here, "normal cooling" is an operation mode that cools air by the cold water generated by the water cooled-type chiller 1, and is an operation mode that cools the air conditioning space.

Upon establishment of a first condition, the flow path switcher 240 switches the flow path of the cooling water such that all the cooling water flowing through the first cooling water passage A1 is supplied to the water cooled-type chiller 1. The first condition is a condition for the start of air conditioning by the air conditioning system 101 in the "normal cooling" operation mode. Specifically, the first condition is established when the request acquirer 210 receives a request for the start of cooling, or when a timing arrives for cooling as determined by an operation schedule.

Figure 6:
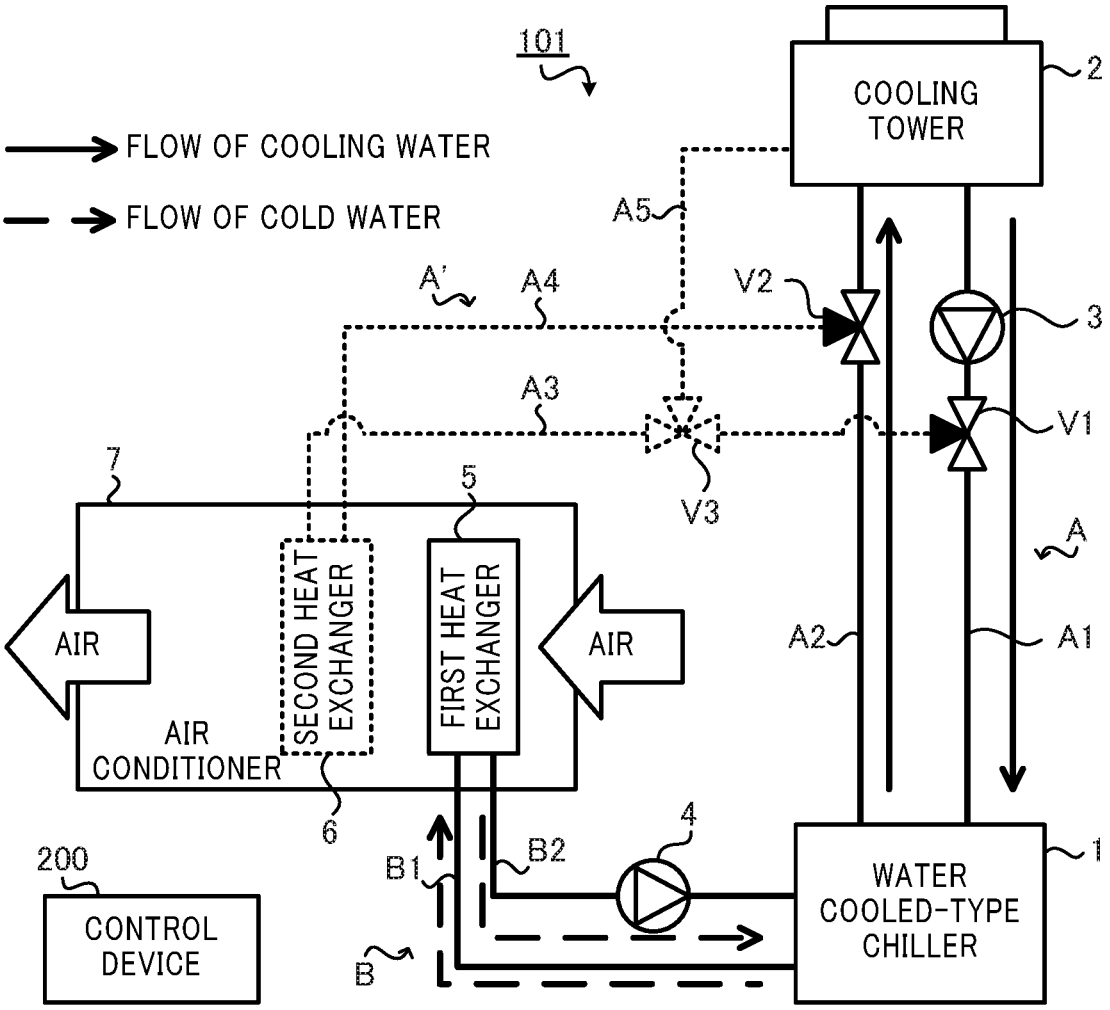
FIG. 6 illustrates a flow path of cooling water during normal cooling in Embodiment 1.

FIG. 6 illustrates the flow path of the cooling water during the normal cooling. In the case of establishment of the first condition, the flow path switcher 240 transmits commands to the first valve V1 and the second valve V2, closes the first valve V1 to the third cooling water passage A3 side, and closes the second valve V2 to the fourth cooling water passage A4 side. Due to closure of the third cooling water passage A3 side of the first valve V1, the cooling water cooled by the cooling tower 2 is not supplied to the cooling water branch passage A' and the second heat exchanger 6, and all of this cooling water is supplied to the water cooled-type chiller 1. Further, due to closing of the fourth cooling water passage A4 side of the second valve V2, the cooling water after cooling of the cold water by the water cooled-type chiller 1 is entirely supplied to the cooling tower 2 without supply to the cooling water branch passage A' and the second heat exchanger 6. In this manner, the cooling water circulates between the cooling tower 2 and the water cooled-type chiller 1. In this flow path, the temperature of the cooling water declines due to absorption of heat by the outside air at the cooling tower 2, and the temperature of the cooling water rises due to cooling of the cold water by the water cooled-type chiller 1.

The cold water pump 4 circulates between the water cooled-type chiller 1 and the first heat exchanger 5 the cold water cooled by the cooling water at the water cooled-type chiller 1. At this time, the temperature of the cold water declines due to heat exchange with the cooling water by the water cooled-type chiller 1, and the temperature of the cold water rises due to heat exchange with the air by the first heat exchanger 5.

The first heat exchanger 5 exchanges heat between the cold water and the air, thereby lowering the temperature and humidity of the air, and supplying the low-temperature, low-humidity air to the air conditioning space. The air conditioning space is thus cooled. Further, the cooling water does not flow into the cooling water branch passage A', and thus the second heat exchanger 6 is not used. In this manner in the "normal cooling" operation mode, the air conditioning system 101 cools the air conditioning space due heat exchange by the first heat exchanger 5.

The direction of closure of the three-way valves in FIG. 6 is indicated by blackening. The flow path of flow of cooling water in the cooling water circulation passage A and the cooling water branch passage A' is indicated by solid lines, and the flow path through which cooling water does not flow is indicated by dashed lines. The same notation is used in the drawings described below.

First Reheat Dehumidification

Secondly, the "first reheat dehumidification" operation mode is described. Reheat dehumidification is an operation mode in which, after lowering of humidity by cooling the air by cold water, the air is reheated by the cooling water and is supplied to the air conditioning space. As reheat dehumidification, the air conditioning system 101 can operate in the two operation modes of the "first reheat dehumidification" and the "second reheat dehumidification". The "first reheat dehumidification" is an operation mode executed in summer when the outside air temperature and the cooling water temperature are relatively high, and the "second reheat dehumidification" is an operation mode executed in the intermediate seasons and winter when the outside air temperature and the cooling water temperature are relatively low.

In the case of establishment of the second condition, the flow path switcher 240 switches the flow path of the cooling water to a flow path by which a portion of the cooling water flowing through the first cooling water passage A1 is supplied to the second heat exchanger 6 via the third cooling water passage A3, and the portion other than the above portion of the cooling water flowing through first cooling water passage A1, that is, the remaining portion, is supplied to the water cooled-type chiller 1. The second condition is a condition in which the air conditioning system 101 starts air conditioning in the "first heat dehumidification" operation mode. Specifically, the second condition is established, in the case in which reheat dehumidification is requested, and the outside air temperature acquired by the temperature acquirer 230 is greater than a first threshold.

Figure 7:
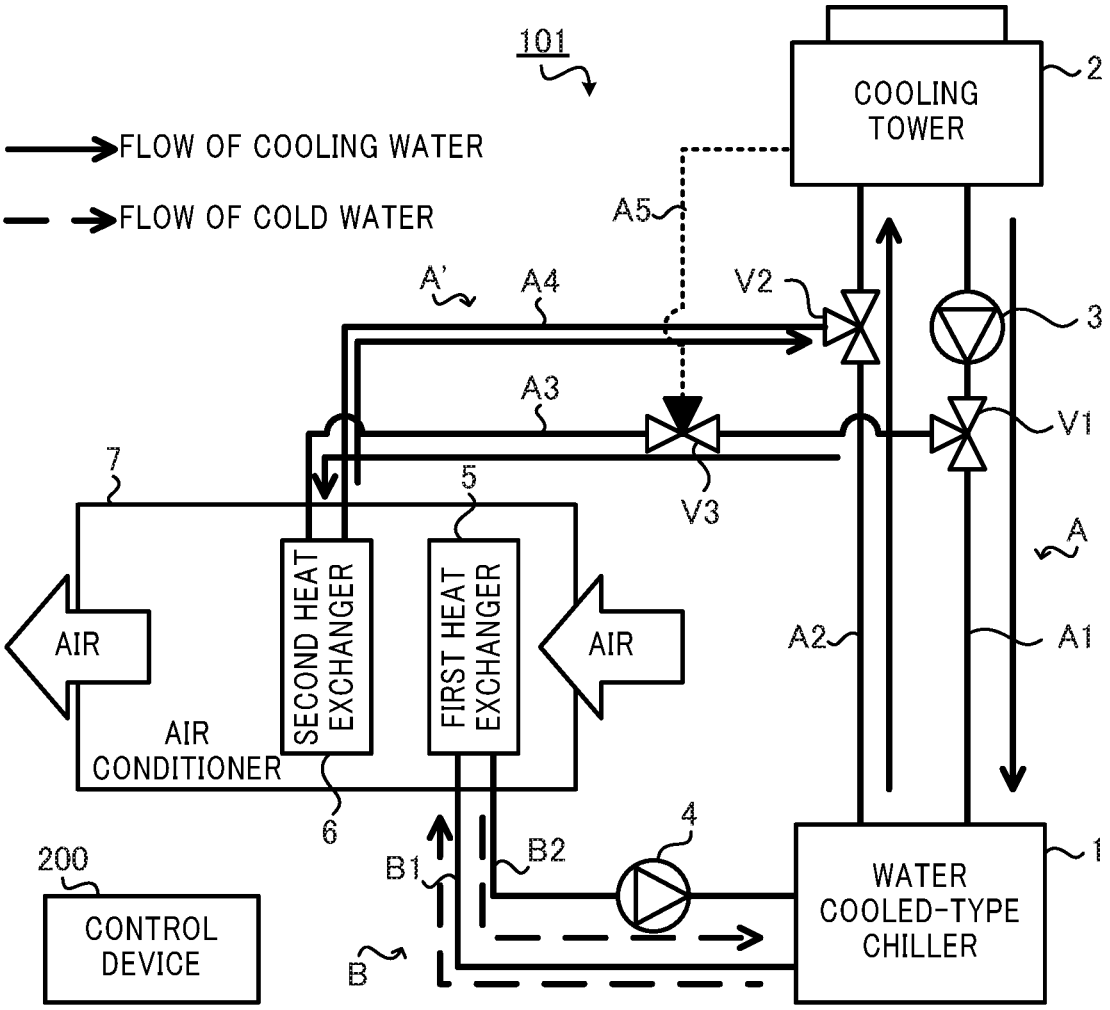
FIG. 7 is a first diagram illustrating a flow path of the cooling water during reheat dehumidification in Embodiment 1.

The case in which reheat dehumidification is requested means the case in which the request acquirer 210 acquires a request to start reheat dehumidification, or alternatively, the case in which a timing arrives for the start of reheat dehumidification as determined by the operation schedule. The first threshold is a temperature serving as a reference for switching between the "first reheat dehumidification" and the "second reheat dehumidification", and is preset to 25° C. or 30° C., for example, FIG. 7 illustrates the flow path of the cooling water during the first reheat dehumidification. In the case of establishment of the second condition, the flow path switcher 240 transmits commands to each of the three valves V1 to V3, and thus the first valve V1 and the second valve V2 open completely, and the fifth cooling water passage A5 side of the third valve V3 closes. Due to complete opening of the first valve V1, the supply of the cooling water cooled by the cooling tower 2 is divided between both the water cooled-type chiller 1 and the second heat exchanger 6. That is to say, of the cooling water cooled by the cooling tower 2, a first portion is supplied to the water cooled-type chiller 1, and a second portion other than the first portion is supplied to the second heat exchanger 6. Further, the second valve V2 is entirely opened, and the fifth cooling water passage A5 side of the third valve V3 is closed. Thus the cooling water of the first portion after cooling the cold water by the water cooled-type chiller 1 and the cooling water of the second portion after heat exchange with the air by the second heat exchanger 6 converge at the second valve V2, mix together, and return to the water cooled-type chiller 1. In this manner, the cooling water circulates between the cooling tower 2 and the water cooled-type chiller 1 and also between the cooling tower 2 and the second heat exchanger 6.

In this flow path, the temperature of the cooling water declines due to absorption of heat by the outside air at the cooling tower 2, increases due to cooling of the cold water by the water cooled-type chiller 1, and declines due to reheating of the air by the second heat exchanger 6. The cooling water of the first portion raised in temperature by the water cooled-type chiller 1 is mixed at the second valve V2 with the cooling water of the second portion lowered in temperature by the second heat exchanger 6, and thus is lowered in temperature to a certain degree prior to returning to the cooling tower 2. Thus load of the cooling tower 2 cooling the cooling water decreases, and energy consumption can be reduced.

The cold water pump 4 circulates, between the water cooled-type chiller 1 and the first heat exchanger 5, the cold water cooled by the cooling water at the water cooled-type chiller 1. At this time, temperature of the cold water declines due to heat exchange with the cooling water by the water cooled-type chiller 1, and rises due to heat exchange with the air by the first heat exchanger 5.

By exchange of heat between the air and the cold water generated by the water cooled-type chiller 1, the first heat exchanger 5 causes a lowering of the temperature and humidity of the air. Due to cooling of the cold water by the first heat exchanger 5, temperature of the air is lowered below the temperature of the cooling water supplied from the cooling tower 2. The second heat exchanger 6 reheats the air by heat exchange between the portion of the cooling water supplied from the cooling tower 2 and the air heat-exchanged with cold water by the first heat exchanger 5.

Figure 8:
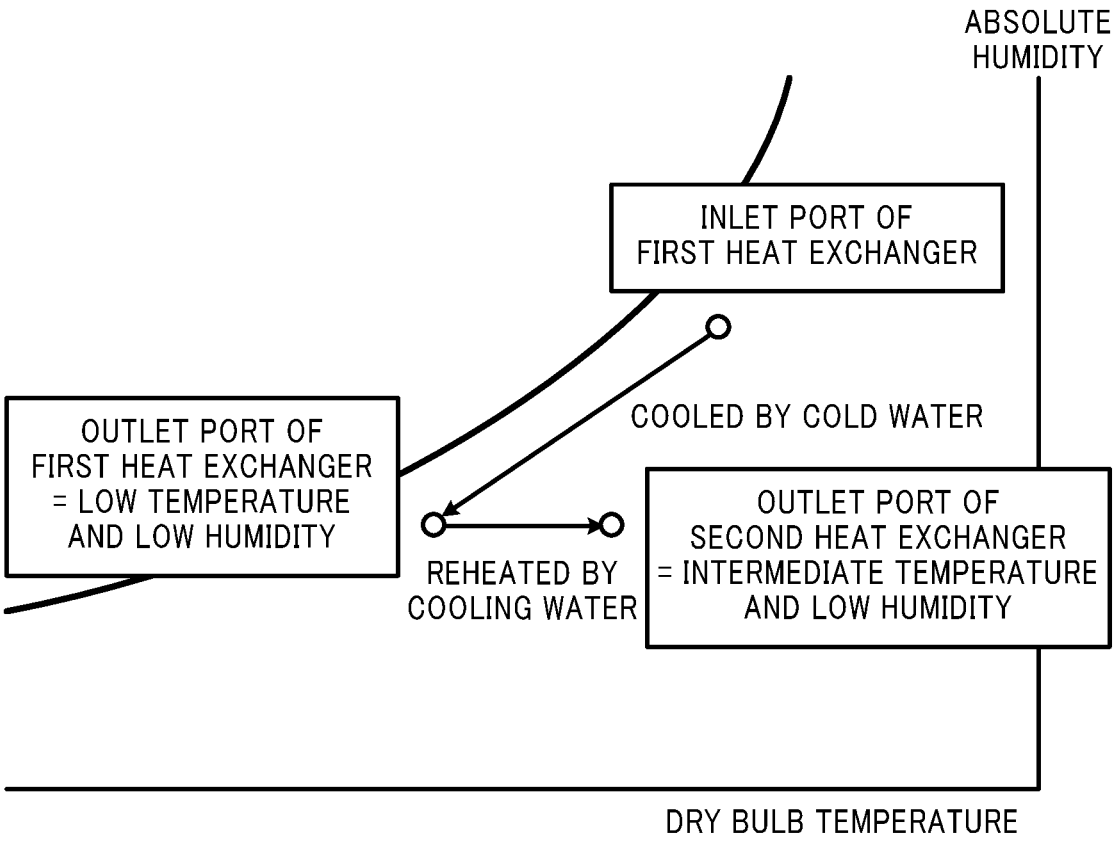
FIG. 8 is a drawing illustrating changes of temperature and humidity of air during the reheat dehumidification.

The changes in temperature and humidity of the air occurring during passage through the first heat exchanger 5 and the second heat exchanger 6 are illustrated on a psychrometric chart in FIG. 8. As illustrated in FIG. 8, at the vicinity of the entrance of the first heat exchanger 5, that is, prior to the air flowing into the air conditioner 7, the temperature and humidity of the air are both relatively high. In contrast, the temperature and humidity of the air in the vicinity of the outlet of the first heat exchanger 5 decline due to cooling by the cold water at the first heat exchanger 5. Thereafter, due to reheating by the cooling water at the second heat exchanger 6, the temperature of the air in the vicinity of the outlet of the second heat exchanger 6 rises. The medium temperature and low humidity air generated in this manner is supplied to the air conditioning space. Thus in the "first reheat dehumidification" operation mode in this manner, the air conditioning system 101 performs reheat dehumidification of the air conditioning space by two-stage heat exchange by the first heat exchanger 5 and the second heat exchanger 6.

Second Reheat Dehumidification

Thirdly, the "second reheat dehumidification" operation mode is described.

In the case of establishment of the third condition, the flow path switcher 240 switches the flow path of the cooling water to a flow path by which: all the cooling water flowing through the first cooling water passage A1 is supplied to the water cooled-type chiller 1, the cooling water cooling the cold water at the water cooled-type chiller 1 is supplied via the second cooling water passage A2 and the fourth cooling water passage A4 to the second heat exchanger 6, and the cooling water heat-exchanged with the air by the second heat exchanger 6 is supplied to the cooling tower 2 via the third cooling water passage A3 and the fifth cooling water passage A5. The third condition is a condition in which the air conditioning system 101 starts air conditioning in the "second reheat dehumidification" operation mode. Specifically, the third condition occurs in the case in which reheat dehumidification is requested, and the outside air temperature acquired by the temperature acquirer 230 is smaller than a first threshold.

Figure 9:
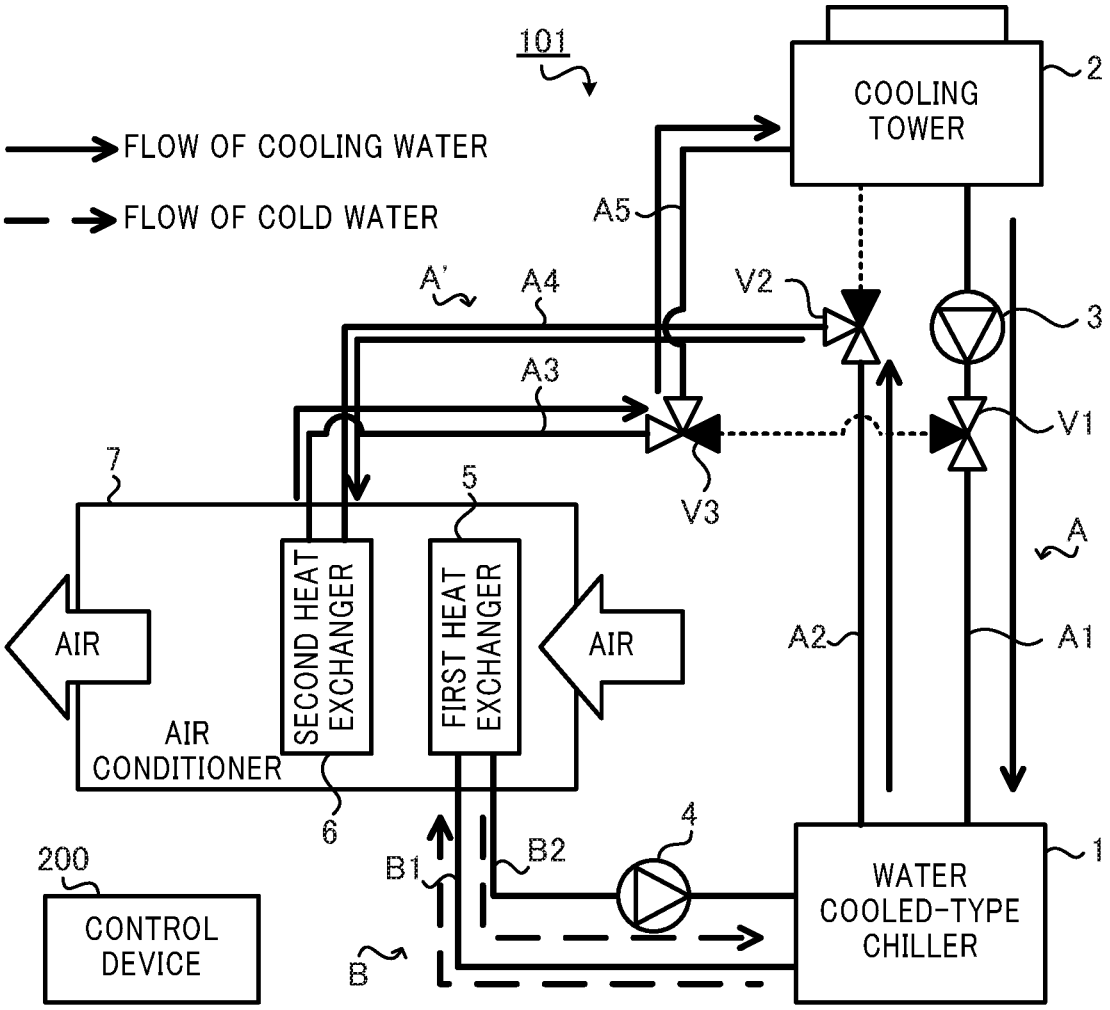
FIG. 9 is a second diagram illustrating the flow path of cooling water during the reheat dehumidification in Embodiment 1.

FIG. 9 illustrates the flow path of the cooling water that occurs in the second reheat dehumidification. In the case of establishment of the third condition, the flow path switcher 240 transmits commands to each of the three valves V1 to V3, thereby closing the third cooling water passage A3 side of the first valve V1, closing the cooling tower 2 side of the second valve V2, and closing the first valve V1 side of the third valve V3. By closing the third cooling water passage A3 side of the first valve V1, the cooling water cooled by the cooling tower 2 is not supplied to the cooling water branch passage A' and the second heat exchanger 6, and is entirely supplied to the water cooled-type chiller 1. Further, by closure of the cooling tower 2 side of the second valve V2, the cooling water, after cooling the cold water at the water cooled-type chiller 1, is not supplied to the cooling tower 2, and is entirely supplied to the second heat exchanger 6 via the fourth cooling water passage A4. Further, by closure of the first valve V1 side of the third valve V3, the cooling water, after heat-exchange with the air at the second heat exchanger 6, returns to the cooling tower 2 via the third cooling water passage A3 and the fifth cooling water passage A5. In this manner, the cooling water circulates in order through the cooling tower 2, the water cooled-type chiller 1, and the second heat exchanger 6.

In this flow path, the temperature of the cooling water declines due to absorption of heat by the outside air at the cooling tower 2, increases due to cooling of the cold water by the water cooled-type chiller 1, and declines due to reheating of the air by the second heat exchanger 6. The cooling water raised in temperature by the water cooled-type chiller 1, due to reheating of the air by the second heat exchanger 6, declines in temperature to a certain degree prior to returning to the cooling tower 2. Thus the load of cooling of the cooling water by the cooling tower 2 decreases, and energy consumption can be reduced.

The cold water pump 4 circulates, between the water cooled-type chiller 1 and the first heat exchanger 5, the cold water cooled by the cooling water at the water cooled-type chiller 1. At this time, the temperature of the cold water declines due to heat exchange with the cooling water by the water cooled-type chiller 1, and increases due to heat exchange with the air by the first heat exchanger 5.

The first heat exchanger 5 exchanges heat between the air and the cold water generated by the water cooled-type chiller 1, thereby causing lower of the temperature and humidity of the air. Due to cooling by the cold water at the first heat exchanger 5, the temperature of the air declines below the temperature of the cooling water after cooling of the cold water by the water cooled-type chiller 1. The second heat exchanger 6 reheats the air by heat exchange between the cooling water after cooling of the cold water by the water cooled-type chiller 1 and the air heat-exchanged with the cold water by the first heat exchanger 5. At this time, the changes in the temperature and humidity of the air are similar to those illustrated in FIG. 8.

In the "second reheat dehumidification" operation mode in this manner, the air conditioning system 101 performs reheat dehumidification of the air conditioning space by two-stage heat exchange by the first heat exchanger 5 and the second heat exchanger 6. Although the cooling water is supplied directly from the cooling tower 2 to the second heat exchanger 6 in the "first reheat dehumidification", in the "second reheat dehumidification", the cooling water is supplied to the second heat exchanger 6 after heating of the cooling water by waste heat at the water cooled-type chiller 1. Thus when the temperature of the cooling water is relatively low, the "second reheat dehumidification" is an operation mode that is more effective than the "first reheat dehumidification" operation mode.

Upon a request for reheat dehumidification, the air conditioning system 101 changes between the "first reheat dehumidification" operation mode and the "second reheat dehumidification" operation mode in accordance with the outside air temperature, and operates. The flow path switcher 240, in accordance with such change in the operation mode, switches the flow path of the cooling water. Thus the reheat dehumidification can be executed by a method suitable for conditions, and thus the energy saving effect can be further increased.

Free Cooling

Fourthly, the "free cooling" operation mode is described. Here, "free cooling" is an operation mode that, in the case in which the temperature of the cooling water is sufficiently low in the winter or an intermediate season, does not use the water cooled-type chiller 1, and cools by the cooling water cooled by the cooling tower 2.

In the case of establishment of the fourth condition, the flow path switcher 240 switches the flow path of the cooling water to a flow path that does not supply to the water cooled-type chiller 1 the cooling water flowing through the first cooling water passage A1, and that supplies all the cooling water flowing through the first cooling water passage A1 to the second heat exchanger 6 via the third cooling water passage A3. The fourth condition is a condition in which the air conditioning system 101 starts air conditioning in the "free cooling" operation mode. Specifically, the fourth condition is established in the case in which air-cooling is requested, and the outside air temperature acquired by the temperature acquirer 230 is lower than a second threshold.

The "case in which air-cooling is requested" occurs when the request acquirer 210 acquires a request to start air-cooling, or when a timing arrives for the start of air-cooling as determined by the operation schedule. The second threshold is a temperature serving as a reference for switching the operation mode from "normal cooling" to "free cooling", and is preset to 5° C. or 10° C., for example.

Figure 10:
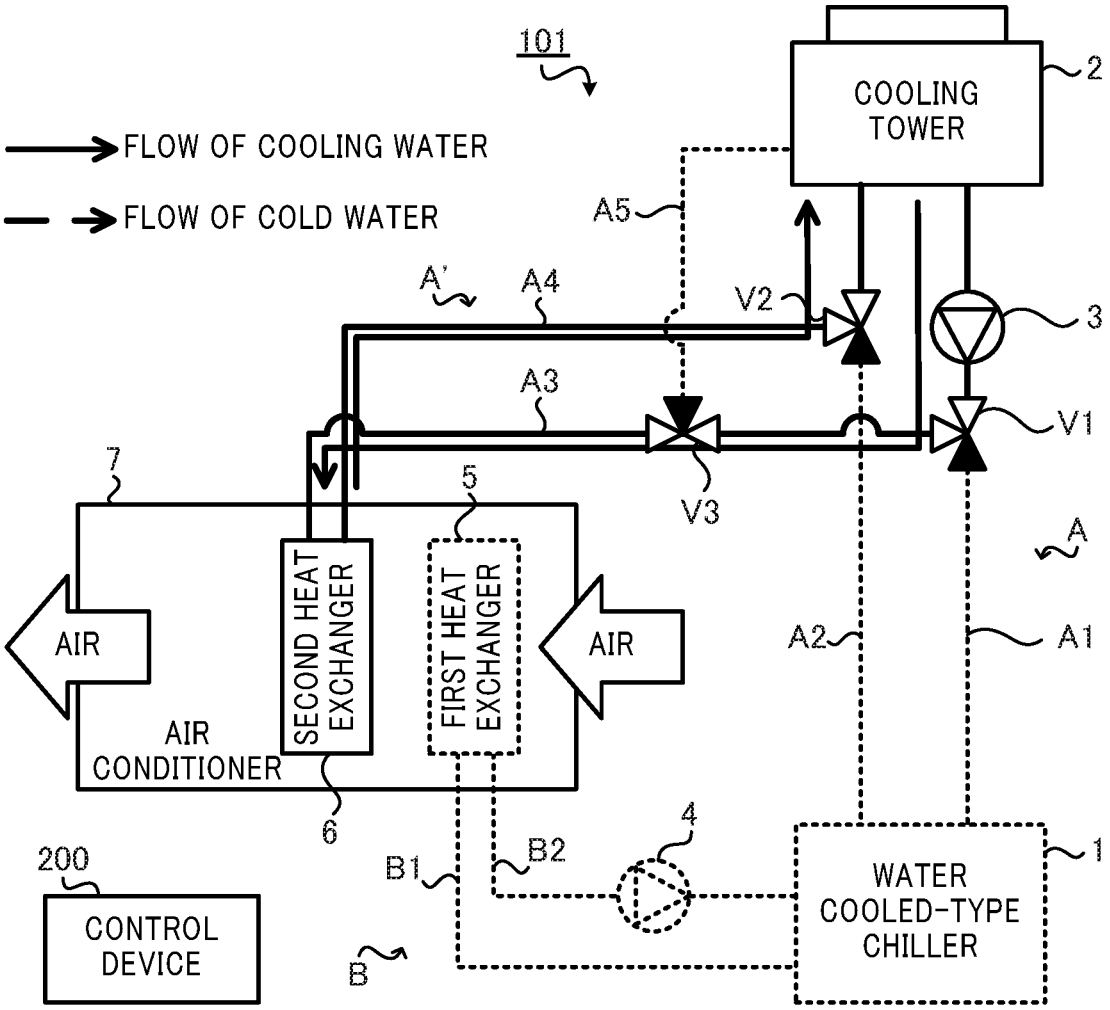
FIG. 10 illustrates a flow path of cooling water during free cooling in Embodiment 1.

FIG. 10 illustrates the flow path of the cooling water occurring during free cooling. In the case of establishment of the fourth condition, the flow path switcher 240 transmits commands to each of the three valves V1 to V3, thereby closing the water cooled-type chiller 1 sides of the first valve V1 and the second valve V2, and closing the fifth cooling water passage A5 side of the third valve V3. Due to closure of the water cooled-type chiller 1 side of the first valve V1, the cooling water cooled by the cooling tower 2 is not supplied to the water cooled-type chiller 1, and is all supplied via the third cooling water passage A3 to the second heat exchanger 6. Further, due to closure of the water cooled-type chiller 1 side of the second valve V2, the cooling water after heat exchange with the air by the second heat exchanger 6 is not supplied to the water cooled-type chiller 1, and is entirely supplied to the cooling tower 2. In this manner, the cooling water circulates between the cooling tower 2 and the second heat exchanger 6. In this flow path, the temperature of the cooling water declines due to absorption of heat by the outside air at the cooling tower 2, and increases due to cooling of the air by the second heat exchanger 6.

The second heat exchanger 6 exchanges heat between the cooling water and the air, thereby lowering the temperature and humidity of the air, and supplying the low-temperature, low-humidity air to the air conditioning space. Such operation cools the air conditioning space. Further, during free cooling, operations of the water cooled-type chiller 1, the cold water pump 4, and the first heat exchanger 5 are stopped.

In the "free cooling" operation mode in this manner, the air conditioning system 101 supplies the cooling water cooled by the outside air at the cooling tower 2 as is to the second heat exchanger 6, thereby cooling the air conditioning space. The water cooled-type chiller 1, the cold water pump 4, and the first heat exchanger 5 are not used, and thus energy consumption can be reduced.

Figure 11:
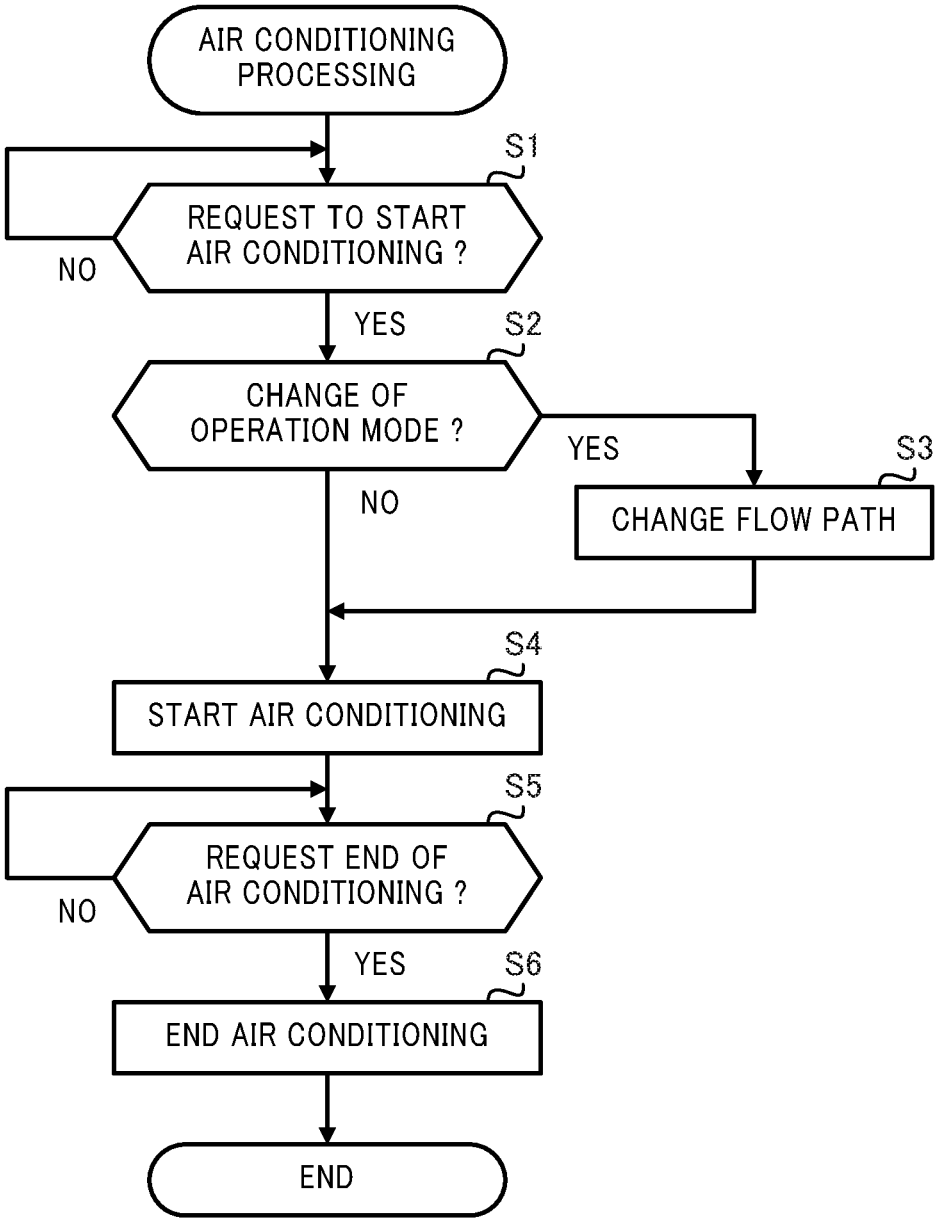
FIG. 11 is a flowchart illustrating air conditioning processing executed by the control device.

The air conditioning processing executed by the control device 200 of the air conditioning system 101 configured in the above manner is described with reference to a flowchart illustrated in FIG. 11. The air conditioning processing illustrated in FIG. 11 is executed as required by the controller 201 when power is turned on to the air conditioning system 101 in a state in which the air conditioning system 101 is capable of air conditioning.

In the air conditioning processing, the controller 201 firstly determines whether a request to start air conditioning is received (step S1). Specifically, the controller 201 determines whether the inputting of the request to start air conditioning from the user via the inputter 207 or the communication unit 204 is received. Further, the controller 201 determines that a request to start air conditioning is also acquired when the timing arrives for the start of air conditioning as determined beforehand by the operation schedule. In step S1, the controller 201 functions as the request acquirer 210.

In the case in which the request for the start of air conditioning is not received (NO in step S1), the controller 201 remains in the processing of step S1, and waits for acquisition of the request for the start of air conditioning.

In contrast, in the case in which the request for the start of air conditioning is received (YES in step S1), the controller 201 determines whether the operation mode of the air conditioning system 101 is to be changed (step S2). For example, in the case of acquisition of a request for change of the operation mode from the user, or in the case in which the outside air temperature satisfies the condition for switching the operation mode, the controller 201 determines that the operation mode is to be changed. In step S2, the controller 201 functions as the request acquirer 210 and the temperature acquirer 230.

In the case of change of the operation mode (YES in step S2), the controller 201 changes the flow path of the cooling water (step S3). Specifically, in accordance with the change of operation mode, the controller 201 transmits commands to switch open or closed the first valve V1, the second valve V2, and the third valve V3. Such operation of the controller 201 changes the flow path of the cooling water to the flow path illustrated on one of FIGS. 6, 7, 9, and 10. In step S3, the controller 201 functions as the flow path switcher 240.

In contrast, in the case in which the operation mode is not switched (NO in step S2), the controller 201 skips the processing of step S3.

When the flow path of the cooling water is set in this manner, the controller 201 starts the air conditioning (step S4). Specifically, the controller 201 transmits commands to start operation via the communication unit 204 to each of the water cooled-type chiller 1, the cooling tower 2, the cooling water pump 3, the cold water pump 4, and the air conditioner 7. In step S4, the controller 201 functions as the air conditioning controller 220.

Thereafter, the controller 201 determines whether a request is acquired for ending air conditioning (step S5). Specifically, the controller 201 determines whether an input from the user of the request for ending air conditioning is received via the inputter 207 or the communication unit 204. Further, the controller 201 determines that the request for ending air conditioning is received also in the case in which a timing arrives for ending of the air conditioning as determined beforehand by the operation schedule. In step S5, the controller 201 functions as the request acquirer 210.

In the case in which the request for ending air conditioning is not acquired (NO in step S5), the controller 201 keeps processing as in step S5, and continues air conditioning until acquiring the request for ending air conditioning.

In contrast, in the case in which the request for ending air conditioning is received (YES in step S5), the controller 201 ends air conditioning (step S6). Specifically, the controller 201 transmits, via the communication unit 204, commands to end operation to each of the water cooled-type chiller 1, the cooling tower 2, the cooling water pump 3, the cold water pump 4, and the air conditioner 7. In step S6, the controller 201 functions as the air conditioning controller 220. By the aforementioned processing, the air conditioning processing illustrated in FIG. 11 ends.

As described above, the air conditioning system 101 according to Embodiment 1 supplies, to the second heat exchanger 6, a portion of the cooling water introduced to the water cooled-type chiller 1 from the cooling tower 2 by the cooling water branch passage A' branching from the cooling water circulation passage A allowing circulation of the cooling water between the cooling tower 2 and the water cooled-type chiller 1. Air is reheated by using the heat of the cooling water without the requirement for a thermal source device dedicated for use in reheating, thereby decreasing energy consumption and reducing costs. Further, the cooling water can be used advantageously even during a relatively high outside air temperature period when free cooling cannot be implemented. The cooling water branch passage A' that allows branching of the cooling water to the air conditioner 7 can be used also in reheat dehumidification rather than just in free cooling, thereby enabling an increase in cost-wise effectiveness relative to the addition of equipment.

Further the air conditioning system 101 can, in accordance with conditions, switch between the operation modes of normal cooling, first reheat dehumidification, second reheat dehumidification, and free cooling. Thus air conditioning is possible that effectively uses cooling water in various types of conditions, and user convenience can be increased.

Embodiment 2

Embodiment 2 of the present disclosure is described next.

Figure 12:
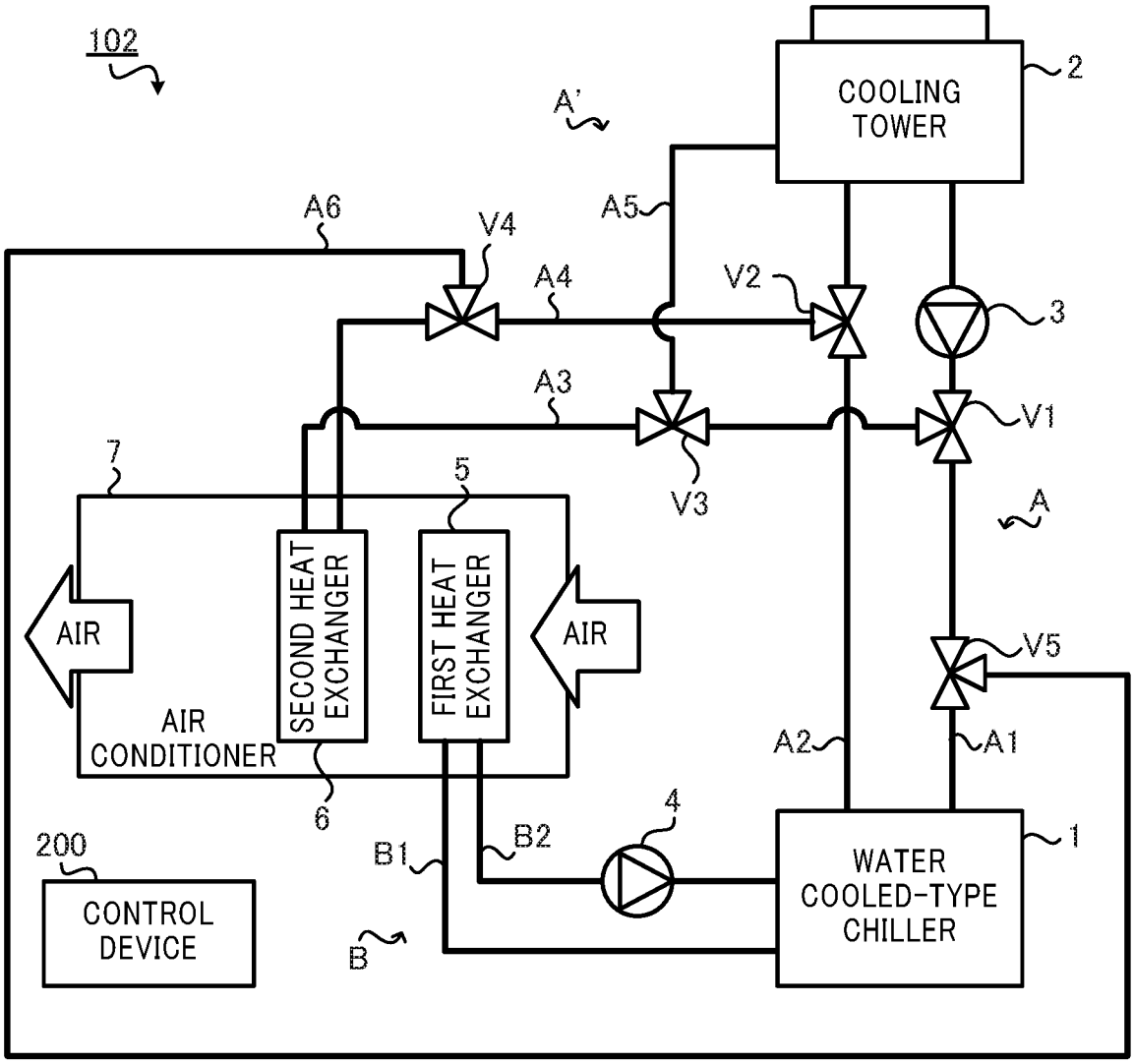
FIG. 12 is a schematic drawing of an air conditioning system according to Embodiment 2 of the present disclosure.

FIG. 12 schematically illustrates an air conditioning system 102 of Embodiment 2. The air conditioning system 102 is equipped with the water cooled-type chiller 1, the cooling tower 2, the cooling water pump 3, the cold water pump 4, the first heat exchanger 5, the second heat exchanger 6, the air conditioner 7, the cooling water circulation passage A, the cooling water branch passage A', the cold water circulation passage B, the first valve V1, the second valve V2, the third valve V3, and the control device 200. The descriptions of these components are omitted due to similarity of these components to those of Embodiment 1.

The air conditioning system 102, in addition to the aforementioned configuration, is equipped with: a sixth cooling water passage A6 for introducing, to the first cooling water passage A1, a portion of the cooling water heat exchanged with air by the second heat exchanger 6, and a fourth valve V4 and a fifth valve V5 for switching the flow path of the cooling water. The sixth cooling water passage A6 connects together a midway part of the fourth cooling water passage A4 and a position between the water cooled-type chiller 1 and the branch position (that is, the position of arrangement of the first valve V1) of branching in the first cooling water passage A1 to the third cooling water passage A3.

At the position in the fourth cooling water passage A4 of the branching to the sixth cooling water passage A6, the fourth valve V4 is arranged, and the fifth valve V5 is arranged in the first cooling water passage A1 at the position of branching to the sixth cooling water passage A6. The fourth valve V4 and the fifth valve V5 are valves of well-known types such as solenoid valves or electromotive valves, and are three-way valves that open and close. The fourth valve V4 opens and closes in accordance with a control command from the flow path switcher 240, and thus switches between supplying and not supplying the cooling water flowing through the fourth cooling water passage A4 to the sixth cooling water passage A6. By opening and closing of the fifth valve V5 in accordance with the control command from the flow path switcher 240, the cooling water flowing through the sixth cooling water passage A6 is switched between supply and non-supply to the first cooling water passage A1.

The air conditioning system 102 is capable of air conditioning in the four operation modes of "normal cooling", the "first reheat dehumidification", the "second reheat dehumidification", and the "free cooling". In accordance with the operation mode executed by the air conditioning system 102, the flow path switcher 240, via the communication unit 204, transmits commands to switch on and off each of the five valves V1 to V5, thereby switching the flow path of the cooling water.

Among the aforementioned operation modes, the three operation modes of the "normal cooling", the "second reheat dehumidification", and the "free cooling" are similar to such modes in Embodiment 1. When the air conditioning system 102 air-conditions in these three operation modes, the flow path switcher 240 closes the sixth cooling water passage A6 side of the fourth valve V4, and closes the sixth cooling water passage A6 side of the fifth valve V5. Thus the flow path of the cooling water is the same as that of Embodiment 1. Thus description of these three operation modes is omitted.

First Reheat Dehumidification

Operation of the air conditioning system 102 in the "first reheat dehumidification" operation mode is described hereinafter.

In the case in which the second condition is established, the flow path switcher 240 switches the flow path of the cooling water to a flow path by which a portion of the cooling water flowing through the first cooling water passage A1 is supplied to the second heat exchanger 6 via the third cooling water passage A3, the portion other than the portion of the cooling water flowing through the first cooling water passage A1 (that is, the remaining portion) is supplied to the water cooled-type chiller 1, and a portion of the cooling water heat-exchanged with the air by the second heat exchanger 6 is supplied to the water cooled-type chiller 1 via the sixth cooling water passage A6 and the first cooling water passage A1. The second condition is a condition in which the air conditioning system 102 starts air conditioning in the "first reheat dehumidification" operation mode. Specifically, the second condition is established in the case of a request for reheat dehumidification, when the outside air temperature acquired by the temperature acquirer 230 is greater than the first threshold.

Figure 13:
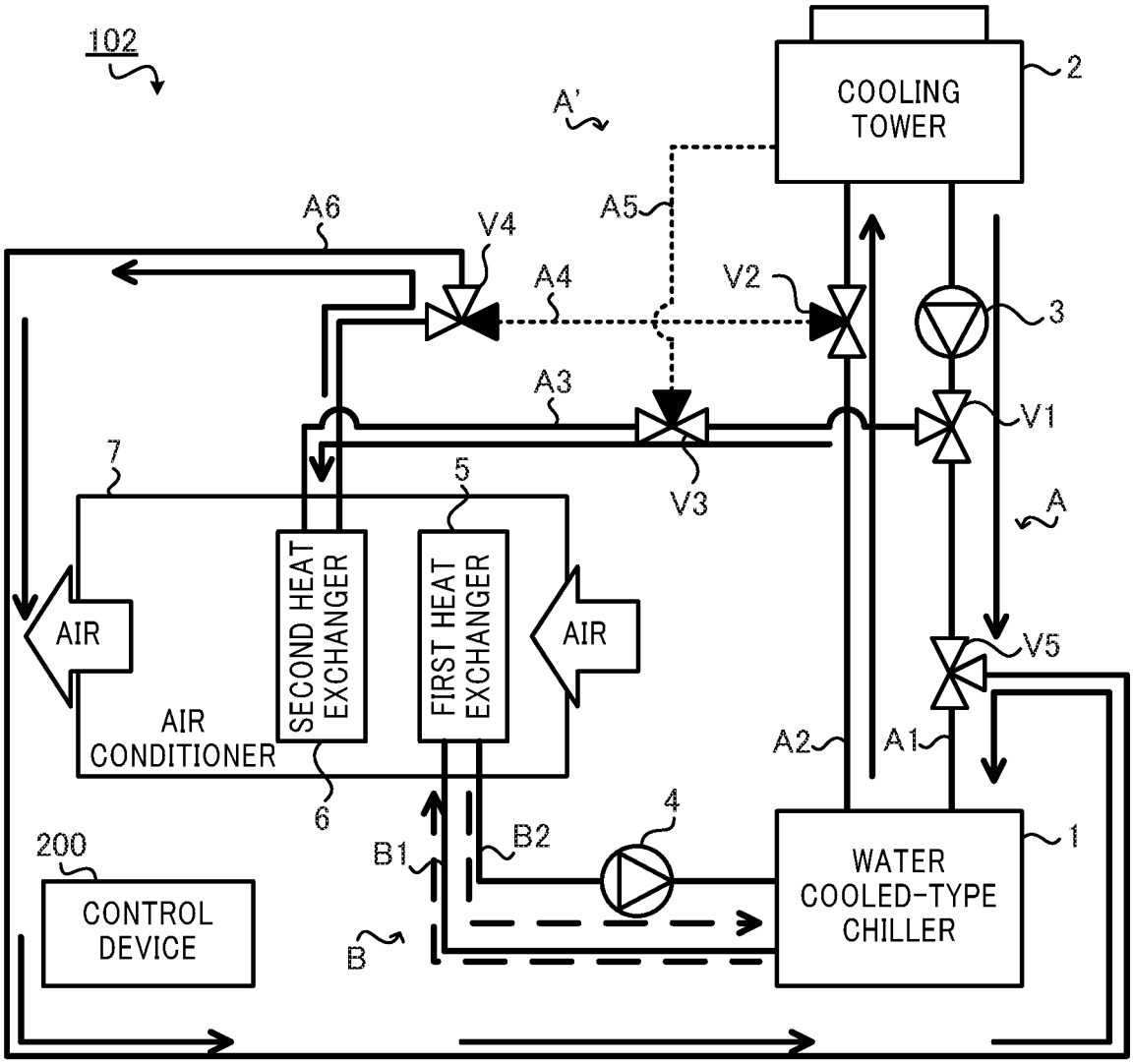
FIG. 13 illustrates a flow path of the cooling water during reheat dehumidification in Embodiment 2.

FIG. 13 illustrates the flow path of the cooling water occurring in the first reheat dehumidification. In the case of establishment of the second condition, the flow path switcher 240 transmits commands to each of the five valves V1 to V5, thereby entirely opening the first valve V1 and the fifth valve V5, closing the fourth cooling water passage A4 side of the second valve V2, closing the fifth cooling water passage A5 side of the third valve V3, and closing the second valve V2 side of the fourth valve V4.

By full opening of the first valve V1, the cooling water cooled by the cooling tower 2 is divided between and is supplied to both the water cooled-type chiller 1 and the second heat exchanger 6. That is to say, of the cooling water cooled by the cooling tower 2, a first portion is supplied to the water cooled-type chiller 1, and a second portion other than the first portion is supplied to the second heat exchanger 6. Further, by closing the fourth cooling water passage A4 side of the second valve V2, the cooling water after cooling the cold water at the water cooled-type chiller 1 is supplied entirely to the cooling tower 2 without supply to the cooling water branch passage A' and the second heat exchanger 6. Further, by closing the fifth cooling water passage A5 side of the third valve V3 and by closing of the second valve V2 side of the fourth valve V4, the cooling water of the second part output from the second heat exchanger 6 to the fourth cooling water passage A4 is supplied to the first cooling water passage A1 via the sixth cooling water passage A6. The cooling water of the second portion flowing from the sixth cooling water passage A6 at the fifth valve V5 after heat exchange with air by the second heat exchanger 6 combines with the cooling water of the first portion branching at the first valve V1, and is supplied to the water cooled-type chiller 1.

In such a flow path, the temperature of the cooling water declines due to absorption of heat by the outside air at the cooling tower 2, rises due to cooling of the cold water by the water cooled-type chiller 1, and further declines due to reheating of the air by the second heat exchanger 6. Thus the temperature of the cooling water flowing into the water cooled-type chiller 1 from the second heat exchanger 6 via the sixth cooling water passage A6 is lower than the temperature of the cooling water cooled by the cooling tower 2. In other words, the cooling water supplied to the water cooled-type chiller 1 has a temperature that is lower than the cooling water cooled by the cooling tower 2.

The cold water pump 4 circulates, between the water cooled-type chiller 1 and the first heat exchanger 5, the cold water cooled by the cooling water at the water cooled-type chiller 1. At this time, the temperature of the cold water declines due to heat exchange with the cooling water by the water cooled-type chiller 1, and rises due to heat exchange with air by the first heat exchanger 5.

The first heat exchanger 5 causes a lowering of temperature and humidity of the air by heat exchange between the air and the cold water generated by the water cooled-type chiller 1. The second heat exchanger 6 exchanges heat between the air heat-exchanged with the cold water by the first heat exchanger 5 and the cooling water after cooling of the cold water by the water cooled-type chiller 1. At this time, the changes in the temperature and humidity of the air are similar to those illustrated in FIG. 8.

In the "first reheat dehumidification" operation mode in Embodiment 2 in this manner, while maintaining the effects of Embodiment 1, the temperature of the cooling water flowing into the water cooled-type chiller 1 can be lowered. Thus the cooling efficiency of the water cooled-type chiller 1 increases, and energy consumption can be decreased. Thus in particular even when the temperature of the cooling water is high, the cold water can be efficiently cooled by the water cooled-type chiller 1.

Embodiment 3

Embodiment 3 of the present disclosure is described next.

Figure 14:
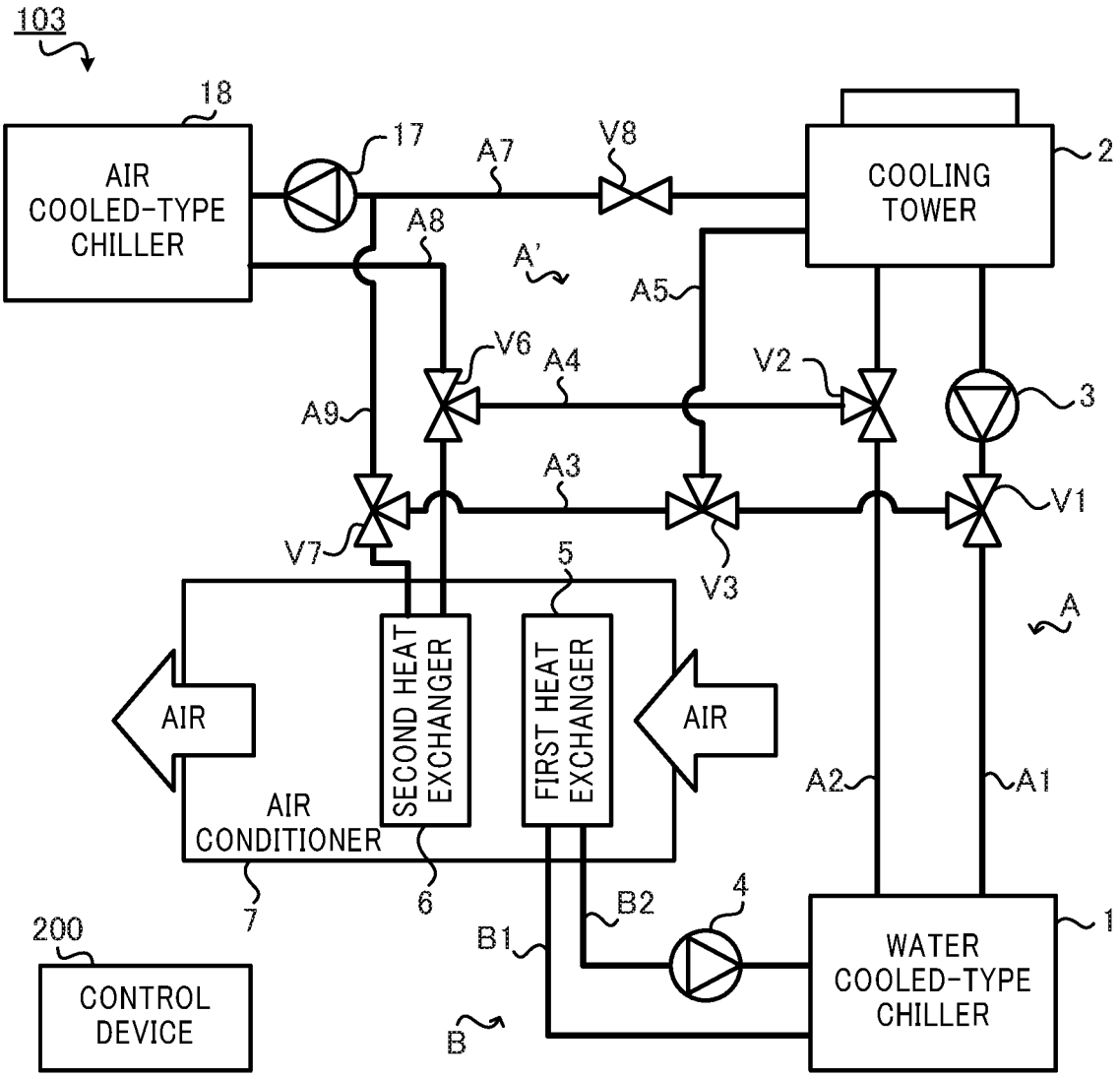
FIG. 14 is a schematic drawing of an air conditioning system of Embodiment 3 of the present disclosure.

FIG. 14 schematically illustrates an air conditioning system 103 of Embodiment 3. The air conditioning system 103 is equipped with the water cooled-type chiller 1, the cooling tower 2, the cooling water pump 3, the cold water pump 4, the first heat exchanger 5, the second heat exchanger 6, the air conditioner 7, the cooling water circulation passage A, the cooling water branch passage A', the cold water circulation passage B, the first valve V1, the second valve V2, the third valve V3, and the control device 200. The descriptions of these components are omitted due to similarity of these components to those of Embodiment 1.

In addition to the aforementioned configuration, the air conditioning system 103 is equipped with: a cooling water pump 17 that circulates the cooling water, an air-cooled type chiller 18 that heats or cools the cooling water, a seventh cooling water passage A7 that introduces the cooling water to the air cooled-type chiller 18, an eighth cooling water passage A8 the introduces to the second heat exchanger 6 the cooling water cooled or heated by the air cooled-type chiller 18, a ninth cooling water passage A9 that introduces to the air cooled-type chiller 18 the cooling water heat-exchanged with air by the second heat exchanger 6, and a sixth valve V6, a seventh valve V7, and an eighth valve V8 that switch the flow path of the cooling water.

Air Cooled-Type Chiller 18

The air cooled-type chiller 18 is a device that heats or cools the cooling water by exchange of heat between the outside air and the cooling water. The air cooled-type chiller 18 is a heat pump-type chiller that uses as a cooling medium a compound such as $CO_2$ (carbon dioxide) or a hydrofluorocarbon (HFC), for example. The air cooled-type chiller 18 is installed, for example, outside the air conditioning space and within the same site as that of the air conditioning space. The water cooled-type chiller 1 functions as a first thermal source device that cools the cold water, and in contrast, the air cooled-type chiller 18 functions as a second thermal source device that heats or cools the cooling water.

The air cooled-type chiller 18 is equipped with components, all of which are non-illustrated, such as a compressor that compresses the cooling medium, a four-way valve that switches the flow path of the cooling medium, a cooling medium-air heat exchanger that exchanges heat between the cooling medium and the outside air, an expansion device that causes expansion of the cooling medium, a cooling medium-water heat exchanger that exchanges heat between the cooling medium and the cooling water, a cooling medium circuit that connects these component together in a loop, and a control board that performs overall control of the air cooled-type chipper 18. The cooling medium circuit is a circuit that circulates the cooling medium, and is also termed a heat pump, refrigeration cycle, or the like.

The control board is equipped with components such as a CPU, ROM, RAM, communication interface, read-writable non-volatile semiconductor memory, and the like. The control board is connected in a communication-capable manner via non-illustrated communication lines to the control device 200. In accordance with commands transmitted from the control device 200, the control board controls the operation of the air cooled-type chiller 18.

In the case of cooling of the cooling water, the control board switches the flow path of the four-way valve such that the cooling medium discharged from the compressor flows into the cooling medium-air heat exchanger, and the control board causes the expansion device and the compressor to operate. Upon operation of the compressor, the cooling medium discharged from the compressor passes through the four-way valve, flows into the cooling medium-air heat exchanger, exchanges heat with the outside air, and condenses. After depressurization by the expansion device, the condensed cooling medium flows into the cooling medium-water heat exchanger, exchanges heat with the cooling water, and volatilizes. The volatilized cooling medium passes through the four-way valve and again is sucked into the compressor. Due to the low temperature cooling medium flowing into the cooling medium-water heat exchanger in this manner, the cooling water passing through the cooling medium-water heat exchanger is cooled.

In the case of heating of the cooling water, the control board switches the flow path of the four-way valve such that the cooling medium discharged from the compressor flows into the cooling medium-air heat exchanger, and the control board causes the expansion device and the compressor to operate.

Upon operation of the compressor, the cooling medium discharged from the compressor passes through the four-way valve, flows into the cooling medium-water heat exchanger, exchanges heat with the cooling water, and condenses. After depressurization by the expansion device, the condensed cooling medium flows into the cooling medium-air heat exchanger, exchanges heat with the outside air, and volatilizes. The volatilized cooling medium passes through the four-way valve and again is sucked into the compressor.

Due to the high temperature cooling medium flowing into the cooling medium-water heat exchanger in this manner, the cooling water passing through the cooling medium-water heat exchanger is heated.

Cooling Water Passages A7 to A9

The seventh cooling water passage A7 connects together the cooling tower 2 and the air cooled-type chiller 18. A cooling water pump 17 is arranged in the seventh cooling water passage A7. The cooling water pump 17 discharges and circulates the cooling water generated by the cooling tower 2. The cooling water pump 17 is equipped with an inverter circuit that changes an amount of the discharged cooling water by adjustment of operational rotation frequency in accordance with a control value per a command from the control device 200. Further, the cooling water pump 3 is called the "first cooling water pump", and the cooling water pump 17 is called the "second cooling water pump".

The eighth valve V8 is arranged at a midway part of the seventh cooling water passage A7. The eighth valve V8 is a two-way valve that opens and closes, and is a widely-known type such as a solenoid valve or an electromotive valve. The eighth valve V8 opens and closes in accordance with control commands from the flow path switcher 240, and thus switches flow of the cooling water on and off in the seventh cooling water passage A7.

The eighth cooling water passage A8 connects together the air cooled-type chiller 18 and a midway part of the fourth cooling water passage A4. The eighth cooling water passage A8 supplies the cooling water output from the air cooled-type chiller 18 to the second heat exchanger 6 via the fourth cooling water passage A4.

The ninth cooling water passage A9 connects together a midway part of the third cooling water passage A3 and the midway part of the seventh cooling water passage A7. More specifically, the ninth cooling water passage A9 connects to a position between the second heat exchanger 6 and a branch position (that is, the position where the third valve V3 is arranged) in the third cooling water passage A3 branching to the fifth cooling water passage A5. The ninth cooling water passage A9 also connects to a position of the interval between the air cooled-type chiller 18 and the position where the eighth valve V8 is arranged in the seventh cooling water passage A7. The ninth cooling water passage A9 supplies, via the seventh cooling water passage A7, to the air cooled-type chiller 18 the cooling water flowing through the third cooling water passage A3.

The sixth valve V6 is arranged at the branch position in the fourth cooling water passage A4 branching to the eighth cooling water passage A8. Further, the seventh valve V7 is arranged at the branch position in the third cooling water passage A3 branching to the ninth cooling water passage A9. The sixth valve V6 and the seventh valve V7 are valves of well-known types such as solenoid valves or electromotive valves, and are three-way valves that open and close. The sixth valve V6 opens and closes in accordance with control commands from the flow path switcher 240, and thus switches on and off to the fourth cooling water passage A4 the supply of the cooling water flowing through the eighth cooling water passage A8. By opening and closing in accordance with the control commands from the flow path switcher 240, the seventh valve V7 switches on and off the supply to the ninth cooling water passage A9 of the cooling water flowing through the third cooling water passage A3.

The air conditioning system 103 can perform air conditioning in six operation modes that are the "normal cooling", the "first reheat dehumidification", the "second reheat dehumidification", the "free cooling", a "second cooling", and a "heating" modes. In accordance with the operation mode executed by the air conditioning system 103, the flow path switcher 240 switches the flow path of the cooling water by transmitting commands for switching open and closed the five valves V1 to V5 via the communication unit 204.

Among the aforementioned operation modes, the four operations modes that are the "normal cooling", the "first reheat dehumidification", the "second reheat dehumidification", and the "free cooling" operation modes are similar to such modes in Embodiment 1. In the case in which the air conditioning system 103 air-conditions in these four operation modes, the flow path switcher 240 closes the eighth cooling water passage A8 side of the sixth valve V6, closes the ninth cooling water passage A9 side of the seventh valve V7, and closes the eighth valve V8. Due to such operation, the flow path of the cooling water is the same as in Embodiment 1.

Normal Cooling

Figure 15:
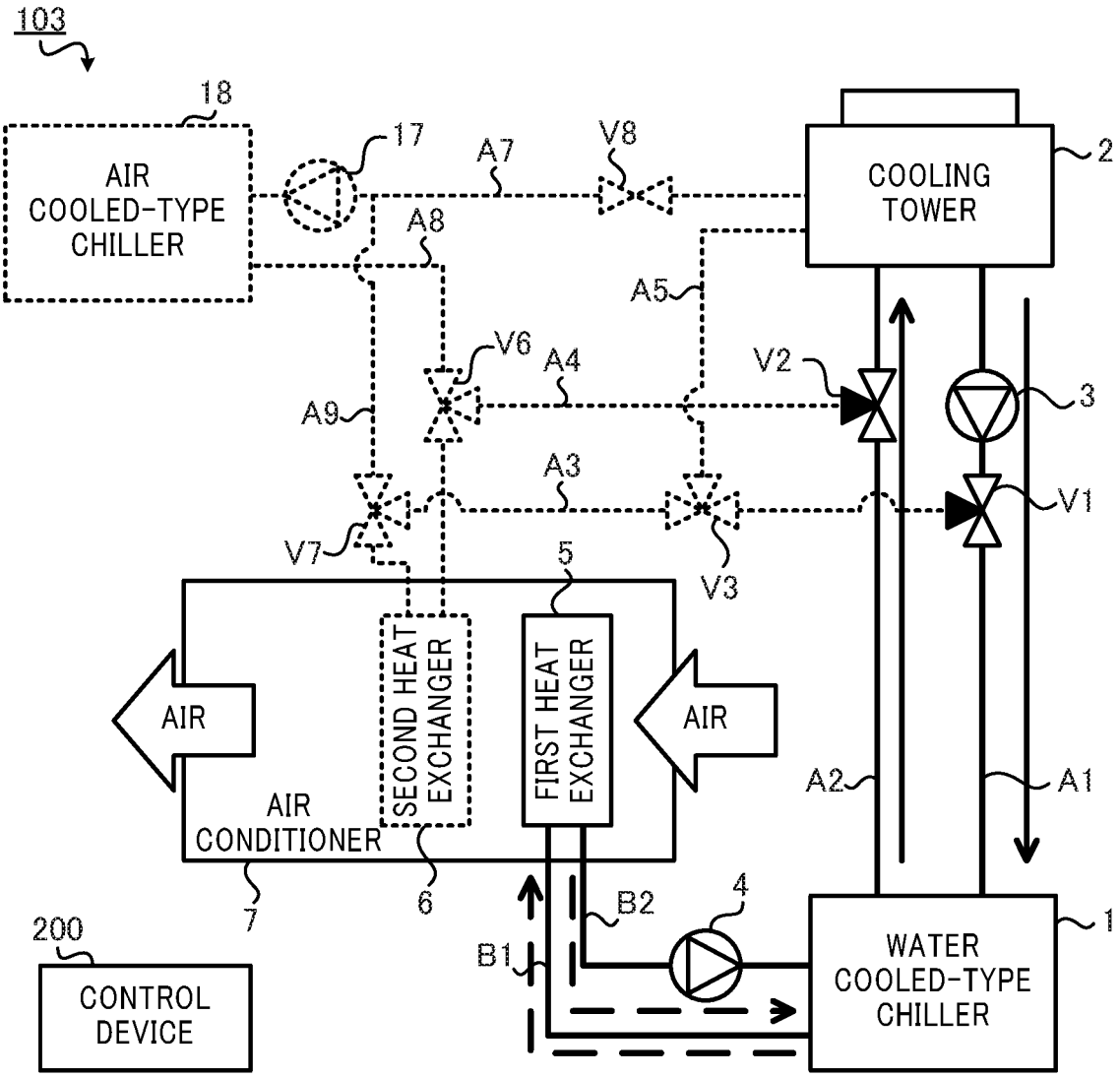
FIG. 15 illustrates a flow path of the cooling water during normal cooling in Embodiment 3.

FIG. 15 illustrates the flow path of the cooling water in the "normal cooling" operation mode.

In the case in which the first condition is established, the flow path switcher 240 transmits commands to the first valve V1 and the second valve V2, closes the third cooling water passage A3 side of the first valve V1, and closes the fourth cooling water passage A4 side of the second valve V2. That is to say, the flow path switcher 240 switches the flow path of the cooling water to a flow path by which all of the cooling water flowing through the first cooling water passage A1 is supplied to the water cooled-type chiller 1 without the cooling water flowing through the first cooling water passage A1 being supplied to the third cooling water passage A3. The cooling water by this means circulates between the cooling tower 2 and the water cooled-type chiller 1.

The cold water pump 4 circulates, between the water cooled-type chiller 1 and the first heat exchanger 5, the cold water cooled by the cooling water at the water cooled-type chiller 1. By heat exchange between the cold water and the air, the first heat exchanger 5 lowers the temperature and humidity of the air, and supplies the low-temperature, low-humidity air to the air conditioning space. The air conditioning space is cooled by this means.

In the "normal cooling" operation mode in this manner, the air conditioning system 103 cools the air conditioning space by heat exchange at the first heat exchanger 5. The cooling water passages A3 to A5 and A7 to A9, the second heat exchanger 6, the cooling water pump 17, and the air cooled-type chiller 18 are not used in this operation mode.

First Reheat Dehumidification

Figure 16:
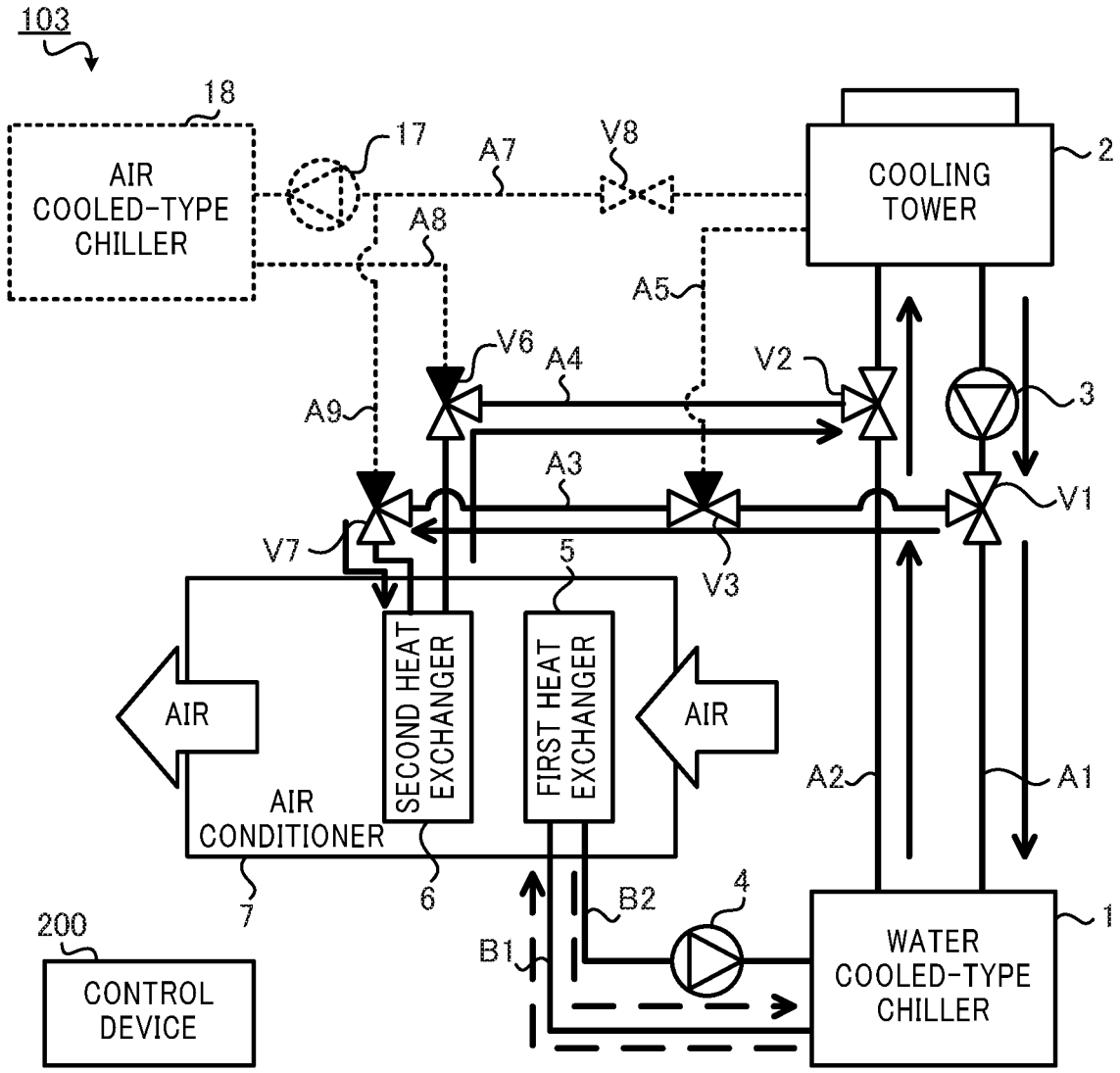
FIG. 16 is a first diagram illustrating a flow path of the cooling water during reheat dehumidification in Embodiment 3.

FIG. 16 illustrates the flow path of the cooling water in the "first reheat dehumidification" operation mode that is executed in the summer when the outside air temperature and the temperature of the cooling water are relatively high.

In the case of establishment of the second condition, by transmitting commands to each of the three valves V1 to V3, the flow path switcher 240 entirely opens the first valve V1 and the second valve V2, and closes the fifth cooling water passage A5 side of the third valve V3. That is to say, the flow path switcher 240 switches the flow path of the cooling water to a flow path such that a portion of the cooling water flowing through the first cooling water passage A1 is supplied to the second heat exchanger 6 via the third cooling water passage A3, and the portion (that is, the remaining portion) other than the portion of the cooling water flowing through the first cooling water passage A1 is supplied to the water cooled-type chiller 1. Thus the cooling water circulates between the cooling tower 2 and the water cooled-type chiller 1, and the cooling water circulates between the cooling tower 2 and the second heat exchanger 6.

The cold water pump 4 circulates, between the water cooled-type chiller 1 and the first heat exchanger 5, the cold water cooled by the cooling water at the water cooled-type chiller 1. The first heat exchanger 5 lowers temperature and humidity of the air by heat exchange between the air and the cold water generated by the water cooled-type chiller 1. The second heat exchanger 6 reheats the air by heat exchange between a portion of the cooling water supplied from the cooling tower 2 and the air heat-exchanged with the cold water by the first heat exchanger 5. At this time, the changes in the temperature and humidity of the air are similar to those illustrated in FIG. 8.

In the "first reheat dehumidification" operation mode this manner, the air conditioning system 103 performs reheat dehumidification of the air conditioning space by two-stage heat exchange by the first heat exchanger 5 and the second heat exchanger 6. In this operation mode, the cooling water passages A5 and A7 to A9, the cooling water pump 17, and the air cooled-type chiller 18 are not used.

Second Reheat Dehumidification

Figure 17:
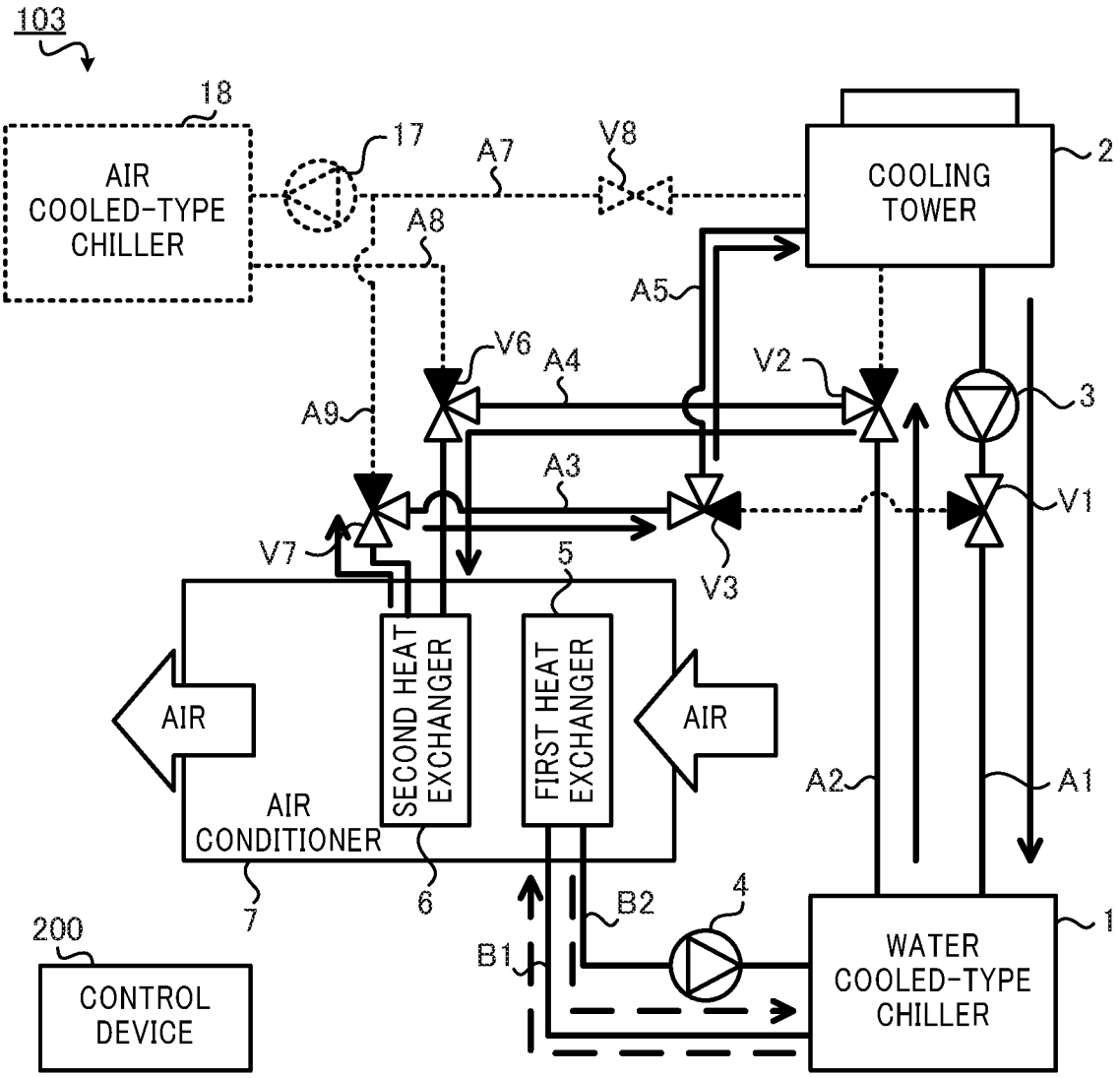
FIG. 17 is a second diagram illustrating a flow path of the cooling water during the reheat dehumidification in Embodiment 3.

FIG. 17 illustrates the flow path of the cooling water in the "second reheat dehumidification" operation mode that is executed in the winter or an intermediate season when the outside air temperature and the cooling water temperature are relatively low.

In the case of establishment of the third condition, by transmitting commands to each of the three valves V1 to V3, the flow path switcher 240 closes the third cooling water passage A3 side of the first valve V1, closes the cooling tower 2 side of the second valve V2, and closes the first valve V1 side of the third valve V3. That is to say, the flow path switcher 240 switches the flow path such that all of the cooling water flowing through the first cooling water passage A1 is supplied to the water cooled-type chiller 1, the cooling water cooling the cold water at the water cooled-type chiller 1 is supplied to the second heat exchanger 6 via the second cooling water passage A2 and the fourth cooling water passage A4, and the cooling water heat-exchanged with the air by the second heat exchanger 6 is supplied to the cooling tower 2 via the third cooling water passage A3 and the fifth cooling water passage A5. Thus the cooling water circulates in order through the cooling tower 2, the water cooled-type chiller 1, and the second heat exchanger 6.

The cold water pump 4 circulates, between the water cooled-type chiller 1 and the first heat exchanger 5, the cold water cooled by the cooling water at the water cooled-type chiller 1. The first heat exchanger 5 lowers the temperature and humidity of the air by heat exchange between the air and the cold water generated by the water cooled-type chiller 1. The second heat exchanger 6 reheats the air by heat exchange between the portion of the cooling water supplied from the cooling tower 2 and the air heat-exchanged with the cold water by the first heat exchanger 5. At this time, the changes in the temperature and humidity of the air are similar to those illustrated in FIG. 8.

In the "second reheat dehumidification" operation mode in this manner, the air conditioning system 103 performs reheat dehumidification of the air conditioning space by two-stage heat exchange by the first heat exchanger 5 and the second heat exchanger 6. In this operation mode, the cooling water passages A7 to A9, the cooling water pump 17, and the air cooled-type chiller 18 are not used.

Free Cooling

Figure 18:
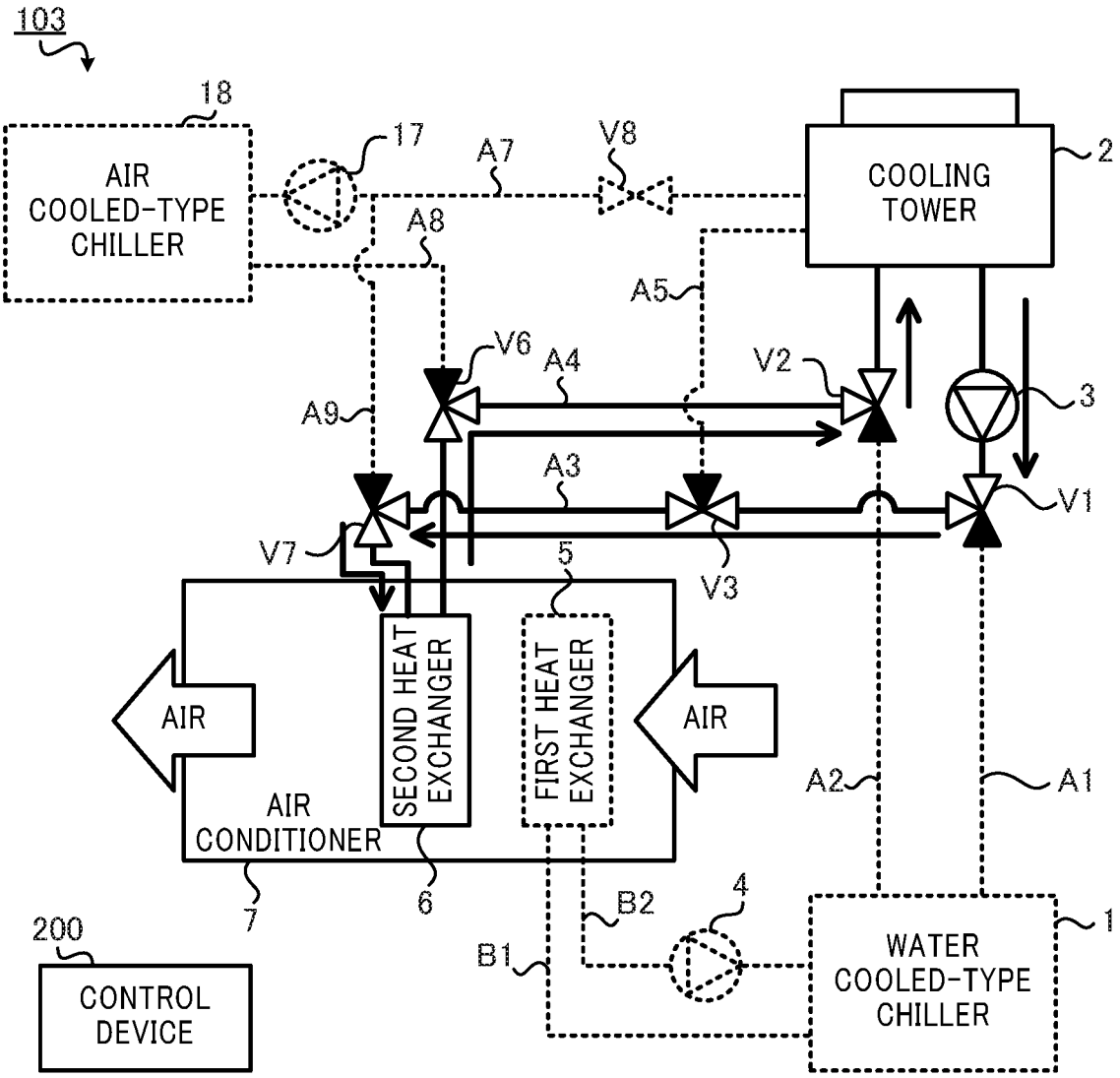
FIG. 18 illustrates a flow path of the cooling water during free cooling in Embodiment 3.

FIG. 18 illustrates the flow path of the cooling water in the "free cooling" operation mode executed when the temperature of the cooling water is sufficiently low in the winter or an intermediate season.

In the case of establishment of the fourth condition, by transmitting commands to each of the three valves V1 to V3, the flow path switcher 240 closes the water cooled-type chiller 1 sides of the first valve V1 and the second valve V2, and closes the fifth cooling water passage A5 side of the third valve V3. That is to say, the flow path switcher 240 switches the flow path of the cooling water to a flow path such that all the cooling water flowing through the first cooling water passage A1 is supplied to the second heat exchanger 6 via the third cooling water passage A3, and the cooling water flowing through the first cooling water passage A1 is not supplied to the water cooled-type chiller 1. By this means, the cooling water circulates between the cooling tower 2 and the second heat exchanger 6.

In this manner, the air conditioning system 103 in the "free cooling" operation mode supplies to the second heat exchanger 6 the cooling water, as is, cooled by the outside air at the cooling tower 2, and cools the air conditioning space. In this operation mode, the cooling water passages A5 and A7 to A9, the water cooled-type chiller 1, the cold water pump 4, the first heat exchanger 5, the cooling water pump 17, and the air cooled-type chiller 18 are not used.

The "second cooling" and the "heating" operation modes that could not be executed by the air conditioning system 101 according to Embodiment 1 are described next.

Second Cooling

The "second cooling" operation mode is an operation mode that cools the cooling water by the air cooled-type chiller 18 in the case in which cooling capacity is insufficient in the "free cooling" operation mode, although there is no requirement for high cooling capacity in comparison to the "normal cooling" operation mode. The "second cooling" operation mode is executed, for example, when the outside air temperature is moderate in an intermediate season.

During the second cooling, the air cooled-type chiller 18 cools the cooling water cooled by the cooling tower. The air conditioning controller 220 transmits commands to the air cooled-type chiller 18 via the communication unit 204 to switch the flow path of the four-way valve, and thus causes cooling of the cooling water.

In the case of establishment of the fifth condition, the flow path switcher 240 switches the flow path of the cooling water such that the cooling water cooled by the cooling tower 2 is supplied to the air cooled-type chiller 18 via the seventh cooling water passage A7, and the cooling water cooled by the air cooled-type chiller 18 is supplied to the second heat exchanger 6 via the eighth cooling water passage A8. Further, in the case of establishment of the fifth condition, the flow path switcher 240 switches the flow path of the cooling water such that the cooling water heat-exchanged with air by the second heat exchanger 6 is supplied to the cooling tower 2 via the third cooling water passage A3 and the fifth cooling water passage A5.

The fifth condition is a condition in which the air conditioning system 103 starts air conditioning in the "second cooling" operation mode. Specifically, the fifth condition is established in the case of a request for air-cooling, when the outside air temperature is lower than a third threshold. "In the case of a request for air-cooling" refers to a case in which the request acquirer 210 acquires a request for the start of air-cooling, or alternatively, is a case in which the timing arrives for the start of air-cooling as determined in the operation schedule.

The third threshold is a temperature serving as a reference for switching the operation mode from the "normal cooling" to the "second cooling", and this is set to a value such as 15° C. or 20° C., for example. The third threshold is set to a temperature higher than the aforementioned second threshold that is a temperature serving as a reference for switching the operation mode to "free cooling". Upon request for air-cooling, in the case in which the outside air temperature is greater than the second threshold and is lower than the third threshold, the air conditioning system 103 cools in the "second cooling" operation mode, and the air conditioning system 103 cools in the "free cooling" operation mode when the outside air temperature is lower than the second threshold, that is to say, when the aforementioned fourth condition is satisfied.

Figure 19:
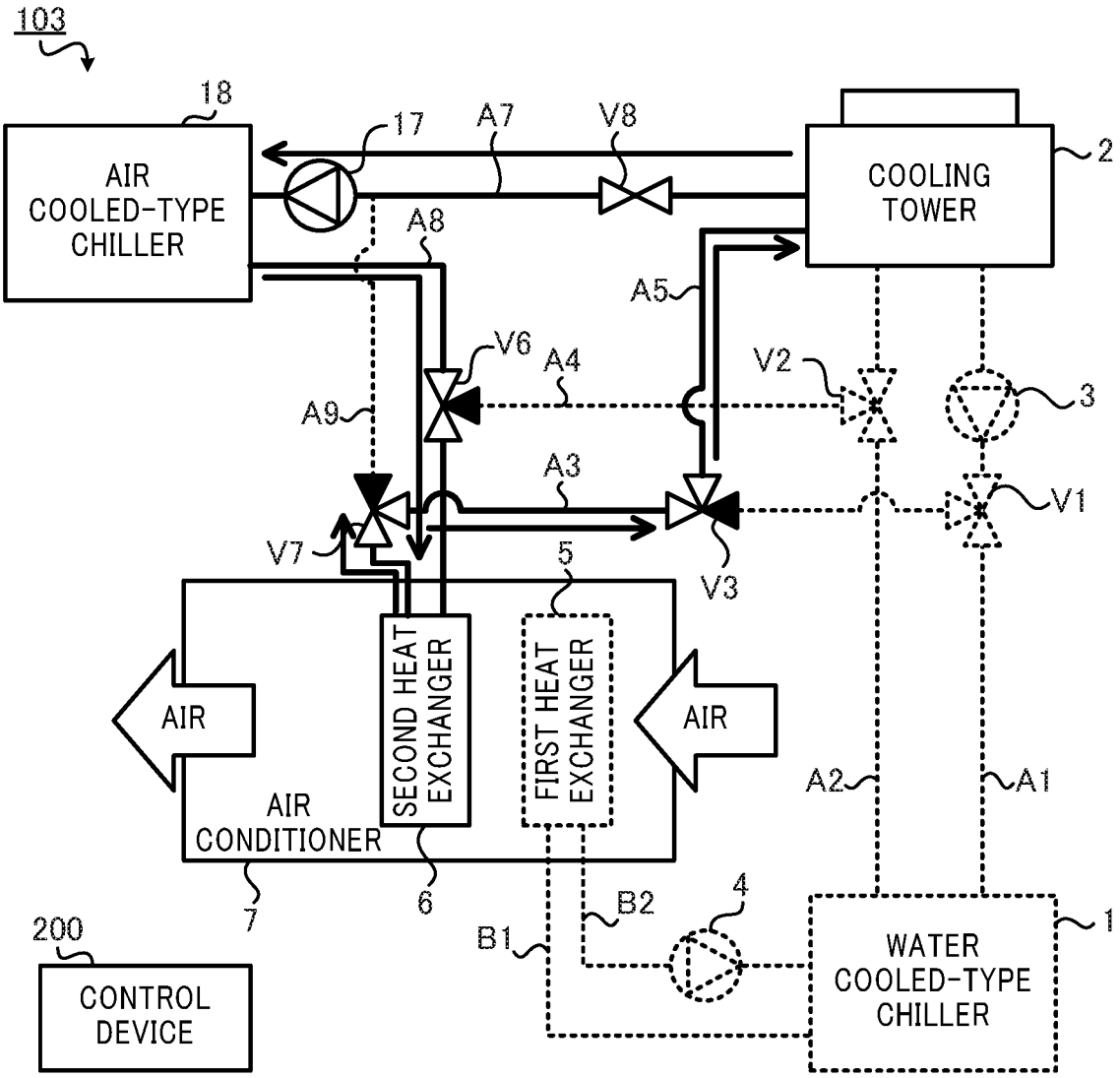
FIG. 19 illustrates a flow path of the cooling water during second cooling in Embodiment 3.

FIG. 19 illustrates the flow path of the cooling water during the second cooling. In the case of establishment of the fifth condition, the flow path switcher 240 transmits commands to each of the six valves V1 to V3 and V6 to V8, thereby fully closing the first valve V1 and the second valve V2, closing the fifth cooling water passage A5 side of the third valve V3, closing the second valve V2 side of the sixth valve V6, closing the ninth cooling water passage A9 side of the seventh valve V7, and opening the eighth valve V8.

Due to full closure of the first valve V1 and the second valve V2, and due to opening of the eighth valve V8, all the cooling water cooled by the cooling tower 2 is supplied to the air cooled-type chiller 18 by the cooling water pump 17 via the seventh cooling water passage A7. By closure of the second valve V2 side of the sixth valve V6, the cooling water output from the air cooled-type chiller 18 is supplied to the second heat exchanger 6 via the eighth cooling water passage A8 and the fourth cooling water passage A4. Due to closure of the ninth cooling water passage A9 side of the seventh valve V7 and the closure of the fifth cooling water passage A5 side of the third valve V3, the cooling water output from the second heat exchanger 6 is supplied to the cooling tower 2 via the third cooling water passage A3 and the fifth cooling water passage A5. In this manner, the cooling water circulates in turn through the cooling tower 2, the air cooled-type chiller 18, and the second heat exchanger 6.

In such a flow path, the temperature of the cooling water declines due to absorption of heat by the outside air at the cooling tower 2, declines further due to cooling by the air cooled-type chiller 18, and increases due to cooling of the air by the second heat exchanger 6. The cooling water having temperature increased by the second heat exchanger 6 returns to the cooling tower 2 and is cooled again.

By performing heat exchange between the cooling water and the air, the second heat exchanger 6 lowers the temperature and humidity of the air, and supplies the low-temperature, low-humidity air to the air conditioning space. The air conditioning space is cooled by this operation. Further, the water cooled-type chiller 1, the cooling water pump 3, the cold water pump 4, and the first heat exchanger 5 are stopped during the second cooling.

In the "second cooling" operation mode in this manner, the water cooled-type chiller 1 and the cold water pump 4 are stopped, and thus the air conditioning system 103 can reduce energy consumption in comparison to the "normal cooling" operation mode. Further, due to cooling of the cooling water by the air cooled-type chiller 18, cooling can be performed at a higher cooling capacity than that of the "free cooling" operation mode.

Heating

The air conditioning system 103 can air-condition in the "heating" operation mode. Such operation is described below.

During heating, the air cooled-type chiller 18 generates hot water by heating the cooling water. The air conditioning controller 220 via the communication unit 204 transmits a command to the air cooled-type chiller 18 to switch the flow path of the four-way valve, and thus causes heating of the cooling water.

In the case of establishment of the sixth condition, the flow path switcher 240 switches the flow path of the cooling water such that the cooling water (heated water) heated by the air cooled-type chiller 18 is supplied to the second heat exchanger 6 via the eighth cooling water passage A8, and the cooling water cooled by the second heat exchanger 6 is supplied to the air cooled-type chiller 18 via the ninth cooling water passage A9. The sixth condition is a condition in which the air conditioning system 103 starts air conditioning in the "heating" operation mode. Specifically, the sixth condition is established in the case in which the request acquirer 210 acquires the request to start air-heating, or alternatively, in the case in which the timing arrives for the start of air-heating as determined in the operation schedule.

Figure 20:
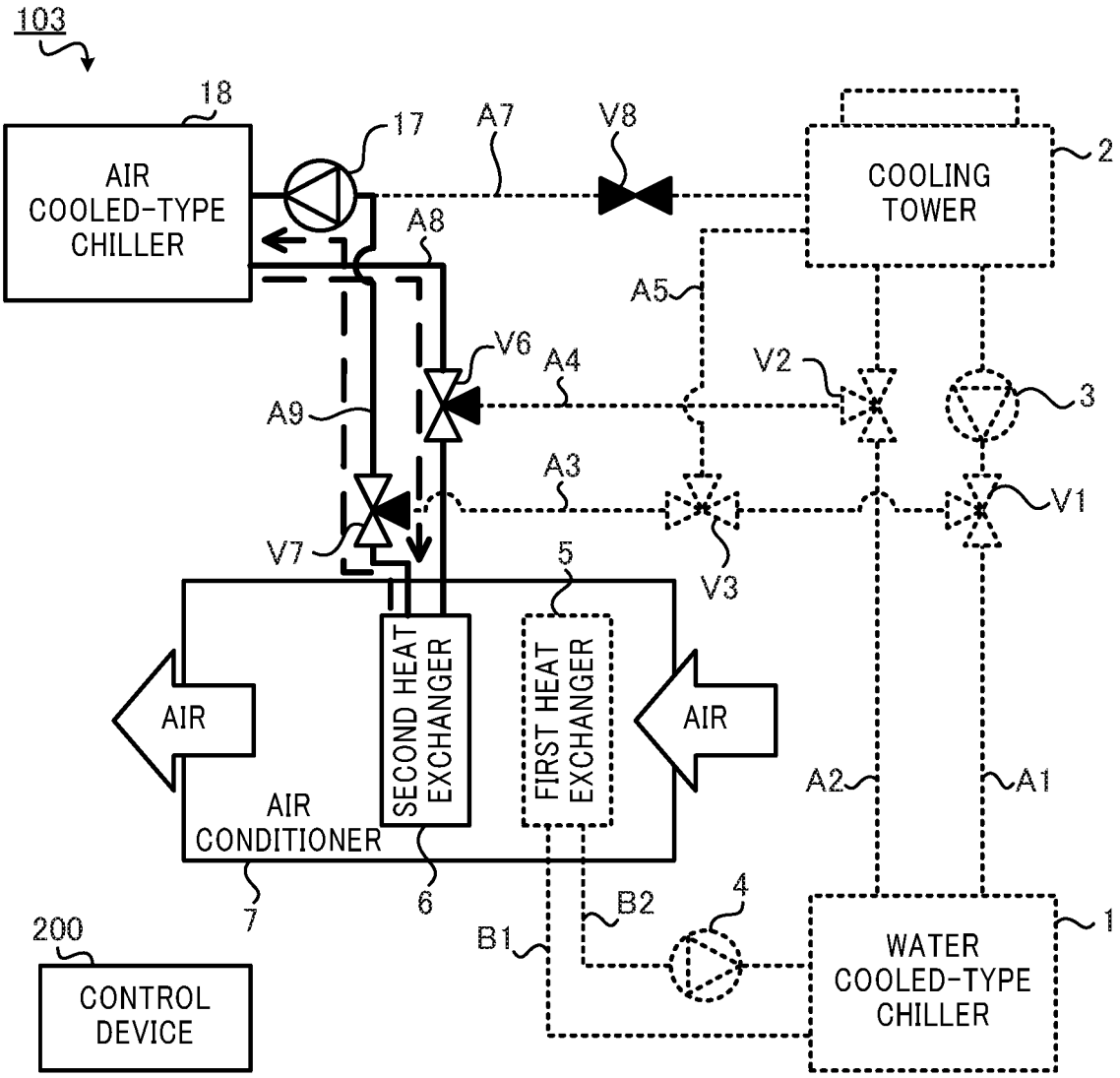
FIG. 20 illustrates a flow path of the cooling water during heating in Embodiment 3.

FIG. 20 illustrates the flow path of the cooling water during heating. In the case of establishment of the sixth condition, the flow path switcher 240 transmits commands to each of the sixth to eighth valves V6 to V8, closes the second valve V2 side of the sixth valve V6, closes the first valve V1 side of the seventh valve V7, and closes the eighth valve V8. Further, due to non-use of the first to third valves V1 to V3, the flow path switcher 240 closes all of such valves.

By closing the second valve V2 side of the sixth valve V6, the cooling water heated by the air cooled-type chiller 18 is supplied to the second heat exchanger 6. By closing of the first valve V1 side of the seventh valve V7 and closing of the eighth valve V8, the cooling water heat-exchanged with air by the second heat exchanger 6 is supplied to the air cooled-type chiller 18. The cooling water in this manner circulates between the air cooled-type chiller 18 and the second heat exchanger 6.

In the flow path configured in this manner, the temperature of the cooling water rises by heating at the air cooled-type chiller 18, and declines due to heat exchange with the air by the second heat exchanger 6. The cooling water lowered in temperature by the second heat exchanger 6 returns to the air cooled-type chiller 18 and is heated again.

The second heat exchanger 6 heats the air by heat exchange between the heated cooling water and the air, and supplies the high temperature air to the air conditioning space. The air conditioning space is heated by such operation. In the "heating" operation mode in this manner, the air conditioning system 103 circulates the heated water generated by the air cooled-type chiller 18 and thus heats the air conditioning space. Further, the water cooled-type chiller 1, the cooling tower 2, the cooling water pump 3, the cold water pump 4, and the first heat exchanger 5 are stopped during heating.

The air conditioning system 103 configured in this manner, in addition to functions for reheat dehumidification and free cooling, is equipped with a function for heating operation, and thus the cost effectiveness and user convenience can be increased.

Modified Examples

Although embodiments of the present disclosure are described above, various types applications and modifications are possible in the implementation of the present disclosure.

For example, the aforementioned air conditioning system 101 according Embodiment 1 and the aforementioned air conditioning system 102 according to Embodiment 2 can air-condition in four operation modes that are the "normal cooling", the "first reheat dehumidification", the "second reheat dehumidification", and the "free cooling" operation modes. However, the air conditioning system according to the present disclosure is not necessarily equipped with functions for air conditioning in all of these operation modes. For example, the air conditioning system may lack the "second reheat dehumidification" function, may lack the "free cooling" function, or may lack both such functions. Alternatively, among these four operation modes, the air conditioning system may be equipped only with the functions for the "normal cooling" and the "first reheat dehumidification", or may be equipped only with the function for the "first reheat dehumidification". In the case of equipment of the air conditioning system with only the function of a single operation mode, the control device 200 may lack the temperature acquirer 230 that acquires the outside air temperature and the flow path switcher 240 that switches the flow path of the cooling water.

In the above embodiments, the temperature acquirer 230 acquires the outside air temperature. However, in the present disclosure, the temperature acquirer 230 may acquire the temperature of the cooling water output from the cooling tower 2. The "temperature of the cooling water output from the cooling tower 2" is the temperature of the cooling water immediately after cooling by heat exchange with the outside air at the cooling tower 2. The cooling water at the cooling tower 2 is cooled by the outside air, and thus the temperature of the cooling water output from the cooling tower 2 correlates highly with the outside air temperature. In this case, the temperature acquirer 230 acquires via the communication unit 204 information of the temperature of the cooling water sensed by a temperature sensor arranged at an outlet port of the cooling water at the cooling tower 2. Then the flow path switcher 240 switches the flow path of the cooling water in accordance with the operation mode acquired by the request acquirer 210 and the temperature of the cooling water acquired by the temperature acquirer 230.

In the aforementioned Embodiment 3, the eighth cooling water passage A8 from which the cooling water heated or cooled by the air cooled-type chiller 18 is output is connected to the fourth cooling water passage A4, and the ninth cooling water passage A9 introducing to the air cooled-type chiller 18 the cooling water discharged from the second heat exchanger 6 is connected to the third cooling water passage A3. However, the eighth cooling water passage A8 may be connected to the third cooling water passage A3, and the ninth cooling water passage A9 may be connected to the fourth cooling water passage A4. The cooling water heated or cooled by the air cooled-type chiller 18 in this case is supplied to the second heat exchanger 6 via the eighth cooling water passage A8 and the third cooling water passage A3. In the "heating" operation mode, the cooling water output from the second heat exchanger 6, via the fourth cooling water passage A4 and the ninth cooling water passage A9, flows into the seventh cooling water passage A7 and is supplied to the air cooled-type chiller 18. However, in the "second cooling" operation mode, the cooling water output from the second heat exchanger 6 is supplied to the cooling tower 2 via the fourth cooling water passage A4 and the second cooling water passage A2. The flow path switcher 240 transmits commands to the second valve V2, the sixth valve V6, and the seventh valve V7, thereby switching the flow path of the cooing water to the flow path configured in this manner.

In the aforementioned embodiments, the control device 200 is described as a device that is installed to the exterior of the water cooled-type chiller 1, the cooling tower 2, and the air conditioner 7, and is described as being independent of these components. However, any of the control boards provided to the water cooled-type chiller 1, the cooling tower 2, and the air conditioner 7 may function as the aforementioned control device 200. Alternatively, the aforementioned functions of the control device 200 may be achieved by cooperation between any of the multiple devices among the controls boards provided to the water cooled-type chiller 1, the cooling tower 2, and the air conditioner 7, and a device installed external to these devices.

In the above embodiments, each of the functions of the request acquirer 210, the air conditioning controller 220, the temperature acquirer 230, and the flow path switcher 240 is performed by a CPU in the controller 201 of the control device 200 executing programs stored in the ROM or the storage 202. However, the controller 201 in the present disclosure may be dedicated hardware. Examples of the meaning of the term "dedicated hardware" include a single circuit, a composite circuit, a programmed processor, an application specific integrated circuit (ASIC), a field-programmable gate array (FPGA), and a combination of such. When the controller 201 is dedicated hardware, the functions of each of the components may be executed by separate hardware units, or the functions of each of the components may be executed by a single hardware unit.

Further, among the functions of various components, a portion may be executed by dedicated hardware, while the remaining portion is executed by software or firmware. In this manner, the controller 201 can execute each of the above functions by hardware, software, firmware, or a combination of such.

An operating program specifying the operations of the control device 200 according to the present disclosure can be applied to an existing personal computer, an information terminal device, or the like, thereby enabling the personal computer, the information terminal device, and the like to function as the control device 200 according to the present disclosure.

Further, any method may be used for distribution of such a program, and for example, the program may be stored and distributed on a computer-readable recording medium such as a compact disc read-only memory (CD-ROM), a digital versatile disc (DVD), a magneto-optical (MO) disc, a memory card, or the like, and the program may be distributed through a communication network such as the Internet.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The present disclosure can be used with advantage for an air conditioning system and the like.

REFERENCE SIGNS LIST

1 Water cooled-type chiller
2 Cooling tower
3, 17 Cooling water pump
4 Cold water pump
5 First heat exchanger
6 Second heat exchanger
7 Air conditioner
18 Air cooled-type chiller

21 Compressor
22 First cooling medium-water heat exchanger
23 Expansion device
24 Second cooling medium-water heat exchanger
25 Cooling medium circuit
26 Control board
31 Air blowing device
101, 102, 103 Air conditioning system
200 Control device
201 Controller
202 Storage
203 Clock
204 Communication unit
205 User interface
206 Display
207 Inputter
209 Bus
210 Request acquirer
220 Air conditioning controller
230 Temperature acquirer
240 Flow path switcher
A Cooling water circulation passage
A' Cooling water branch passage
B Cold water circulation passage
A1, A2, A3, A4, A5, A6, A7, A8, A9 Cooling water passage
B1, B2 Cold water passage
V1-V3, V4, V5, V6, V7, V8 Valve

The invention claimed is:

1. An air conditioning system comprising:

a cooling tower configured to cool cooling water;

a chiller configured to cool cold water by using, as a cold thermal source, the cooling water cooled by the cooling tower;

a cooling water circulation passage configured to allow circulation of the cooling water between the cooling tower and the chiller;

a first heat exchanger configured to exchange heat between air and the cold water cooled by the chiller;

a cold water circulation passage configured to allow circulation of the cold water between the chiller and the first heat exchanger;

a second heat exchanger configured to exchange heat between a portion of the cooling water cooled by the cooling tower and the air heat-exchanged with the cold water by the first heat exchanger;

a cooling water branch passage, branching from the cooling water circulation passage, configured to (i) introduce to the second heat exchanger the portion of the cooling water cooled by the cooling tower, and (ii) introduce to the cooling water circulation passage the portion of the cooling water heat-exchanged with the air by the second heat exchanger; and a flow path switcher configured to switch a flow path of the cooling water in the cooling water circulation passage and the cooling water branch passage, wherein the second heat exchanger is installed downstream of the first heat exchanger along a flow of the air, upon establishment of a first condition, the flow path switcher switches the flow path of the cooling water to supply to the chiller all of the cooling water cooled by the cooling tower, and upon establishment of a second condition, the flow path switcher switches the flow path of the cooling water to (i) supply the portion of the cooling water cooled by the cooling tower to the second heat exchanger, and (ii) supply to the chiller a portion of the cooling water cooled by the cooling tower other than the portion of the cooling water supplied to the second heat exchanger.

2. The air conditioning system according to claim 1, wherein the cooling water circulation passage comprises (i) a first cooling water passage configured to introduce to the chiller the cooling water cooled by the cooling tower, and (ii) a second cooling water passage configured to introduce to the cooling tower the cooling water used by the chiller to cool the cold water, and the cooling water branch passage comprises (i) a third cooling water passage configured to introduce to the second heat exchanger the portion of the cooling water cooled by the cooling tower, and (ii) a fourth cooling water passage configured to introduce to the second cooling water passage the portion of the cooling water heat-exchanged with the air by the second heat exchanger.

3. The air conditioning system according to claim 2, wherein the cooling water branch passage further comprises a fifth cooling water passage configured to introduce to the cooling tower the cooling water flowing through the third cooling water passage, and upon establishment of a third condition, the flow path switcher switches the flow path of the cooling water to (i) supply to the chiller all the cooling water flowing through the first cooling water passage, (ii) supply the cooling water used by the chiller to cool the cold water to the second heat exchanger via the second cooling water passage and the fourth cooling water passage, and (iii) supply the cooling water heat-exchanged with the air by the second heat exchanger to the cooling tower via the third cooling water passage and the fifth cooling water passage.

4. The air conditioning system according to claim 3, wherein the second condition is established when (i) reheat dehumidification is requested, and (ii) an outside air temperature or a temperature of the cooling water output from the cooling tower is higher than a first threshold, and the third condition is established when (i) reheat dehumidification is requested, and (ii) the outside air temperature or the temperature of the cooling water output from the cooling tower is lower than the first threshold.

5. The air conditioning system according to claim 2, wherein upon establishment of a fourth condition, the flow path switcher switches the flow path of the cooling water to supply all of the cooling water cooled by the cooling tower to the second heat exchanger via the third cooling water passage.

6. The air conditioning system according to claim 5, wherein the fourth condition is established when (i) air-cooling is requested, and (ii) an outside air temperature or a temperature of the cooling water output from the cooling tower is lower than a second threshold.

7. The air conditioning system according to claim 3, further comprising:

a second chiller configured to heat or cool the cooling water;

a seventh cooling water passage configured to introduce the cooling water to the second chiller; and an eighth cooling water passage configured to introduce to the second heat exchanger the cooling water heated or cooled by the second chiller, wherein the second heat exchanger exchanges heat between the air and the cooling water heated or cooled by the second chiller.

8. The air conditioning system according to claim 7, wherein the second chiller cools the cooling water cooled by the cooling tower, and upon establishment of a fifth condition, the flow path switcher switches the flow path of the cooling water to (i) supply the cooling water cooled by the cooling tower to the second chiller via the seventh cooling water passage, and (ii) supply the cooling water cooled by the second chiller to the second heat exchanger via the eighth cooling water passage.

9. The air conditioning system according to claim 8, wherein the cooling water branch passage further comprises a fifth cooling water passage configured to introduce to the cooling tower the cooling water flowing through the third cooling water passage, and upon establishment of the fifth condition, the flow path switcher switches the flow path of the cooling water to supply the cooling water heat-exchanged with the air by the second heat exchanger to the cooling tower via the third cooling water passage and the fifth cooling water passage.

10. The air conditioning system according to claim 9, wherein the fifth condition is established when (i) air-cooling is requested, and (ii) an outside air temperature or a temperature of the cooling water output from the cooling tower is lower than a third threshold.

11. The air conditioning system according to claim 7, further comprising:

a ninth cooling water passage configured to introduce to the second chiller the cooling water heat-exchanged with the air by the second heat exchanger, wherein the second chiller heats the cooling water, and upon establishment of a sixth condition, the flow path switcher switches the flow path of the cooling water to (i) supply the cooling water heated by the second chiller to the second heat exchanger via the eighth cooling water passage, and (ii) supply the cooling water cooled by the second heat exchanger to the second chiller via the ninth cooling water passage.

12. An air conditioning system comprising:

a cooling tower configured to cool cooling water;

a chiller configured to cool cold water by using, as a cold thermal source, the cooling water cooled by the cooling tower;

a cooling water circulation passage configured to allow circulation of the cooling water between the cooling tower and the chiller;

a first heat exchanger configured to exchange heat between air and the cold water cooled by the chiller;

a cold water circulation passage configured to allow circulation of the cold water between the chiller and the first heat exchanger;

a second heat exchanger configured to exchange heat between a portion of the cooling water cooled by the cooling tower and the air heat-exchanged with the cold water by the first heat exchanger; and a cooling water branch passage, branching from the cooling water circulation passage, configured to (i) introduce to the second heat exchanger the portion of the cooling water cooled by the cooling tower, and (ii) introduce to the cooling water circulation passage the portion of the cooling water heat-exchanged with the air by the second heat exchanger, wherein the second heat exchanger is installed downstream of the first heat exchanger along a flow of the air, the cooling water circulation passage comprises (i) a first cooling water passage configured to introduce to the chiller the cooling water cooled by the cooling tower, and (ii) a second cooling water passage configured to introduce to the cooling tower the cooling water used by the chiller to cool the cold water, and the cooling water branch passage comprises (i) a third cooling water passage configured to introduce to the second heat exchanger the portion of the cooling water cooled by the cooling tower, and (ii) a sixth cooling water passage configured to introduce to the first cooling water passage the portion of the cooling water heat-exchanged with the air by the second heat exchanger.

13. The air conditioning system according to claim 12, further comprising:

a flow path switcher configured to switch a flow path of the cooling water in the cooling water circulation passage and the cooling water branch passage, wherein upon establishment of a first condition, the flow path switcher switches the flow path of the cooling water to supply to the chiller all of the cooling water flowing through the first cooling water passage, and upon establishment of a second condition, the flow path switcher switches the flow path of the cooling water to (i) supply the portion of the cooling water cooled by the cooling tower to the second heat exchanger via the third cooling water passage, (ii) supply to the chiller a portion of the cooling water cooled by the cooling tower other than the portion of the cooling water supplied to the second heat exchanger, and (iii) supply the portion of the cooling water heat-exchanged with the air by the second heat exchanger to the chiller via the sixth cooling water passage and the first cooling water passage.

* * * * *